US011771138B2

(12) United States Patent
Lim et al.

(10) Patent No.: US 11,771,138 B2
(45) Date of Patent: Oct. 3, 2023

(54) AEROSOL GENERATING DEVICE AND METHOD FOR PROVIDING SMOKING RESTRICTION FUNCTION IN AEROSOL GENERATING DEVICE

(71) Applicant: KT&G CORPORATION, Daejeon (KR)

(72) Inventors: Hun Il Lim, Seoul (KR); Jong Sub Lee, Seongnam-si (KR); Dae Nam Han, Daejeon (KR); Jang Uk Lee, Seoul (KR); Jung Ho Han, Daejeon (KR); Jin Young Yoon, Seoul (KR); Young Lea Kim, Seoul (KR); Ji Soo Jang, Seoul (KR); Wang Seop Lim, Anyang-si (KR); Moon Bong Lee, Seoul (KR); Soung Ho Ju, Daejeon (KR); Du Jin Park, Seoul (KR); Seong Won Yoon, Yongin-si (KR)

(73) Assignee: KT&G CORPORATION, Daejeon (KR)

( * ) Notice: Subject to any disclaimer, the term of this patent is extended or adjusted under 35 U.S.C. 154(b) by 282 days.

(21) Appl. No.: 16/604,447

(22) PCT Filed: Apr. 9, 2018

(86) PCT No.: PCT/KR2018/004129

§ 371 (c)(1),
(2) Date: Oct. 10, 2019

(87) PCT Pub. No.: WO2018/190589

PCT Pub. Date: Oct. 18, 2018

(65) Prior Publication Data

US 2020/0154773 A1 May 21, 2020

(30) Foreign Application Priority Data

Apr. 11, 2017 (KR) ..... 10-2017-0046938
Jun. 19, 2017 (KR) ..... 10-2017-0077586
Jul. 3, 2017 (KR) ..... 10-2017-0084386

(51) Int. Cl.
*A24F 40/57* (2020.01)
*A24F 40/65* (2020.01)
(Continued)

(52) U.S. Cl.
CPC ..... *A24F 40/57* (2020.01); *A24F 40/51* (2020.01); *A24F 40/53* (2020.01); *A24F 40/60* (2020.01); *A24F 40/65* (2020.01)

(58) Field of Classification Search
CPC ..... A24F 40/51; A24F 40/53; A24F 40/65; A24F 40/57; A24F 40/60
See application file for complete search history.

(56) References Cited

U.S. PATENT DOCUMENTS 2,638,904 A 5/1953 Mitchell
4,585,014 A 4/1986 Fry
(Continued)

FOREIGN PATENT DOCUMENTS

CA 2973143 A1 8/2016
CA 2975654 A1 8/2016
(Continued)

OTHER PUBLICATIONS

Office Action dated Jul. 22, 2021 in Korean Application No. 10-2021-0051359.
(Continued)

*Primary Examiner* — Anthony Calandra
(74) *Attorney, Agent, or Firm* — Sughrue Mion, PLLC

(57) ABSTRACT

In an aerosol generating apparatus and a method of providing a smoking restriction function in the aerosol generating apparatus, a smoking initiation request is received from a
(Continued)

user, and supply of power to a heater is controlled according to whether the smoking initiation request satisfies a smoking restriction condition.

5 Claims, 37 Drawing Sheets

(51) Int. Cl.

| | |
|---|---|
| ***A24F 40/60*** | (2020.01) |
| ***A24F 40/53*** | (2020.01) |
| ***A24F 40/51*** | (2020.01) |

(56) References Cited

U.S. PATENT DOCUMENTS 4,637,407 A 1/1987 Bonanno et al.
5,144,962 A 9/1992 Counts et al.
5,240,012 A 8/1993 Ehrman et al.
5,249,586 A 10/1993 Morgan et al.
5,369,723 A 11/1994 Counts et al.
5,388,594 A 2/1995 Counts et al.
5,465,738 A 11/1995 Rowland
5,479,948 A 1/1996 Counts et al.
5,499,636 A 3/1996 Baggett, Jr. et al.
5,591,368 A 1/1997 Fleischhauer et al.
5,666,977 A 9/1997 Higgins et al.
5,878,752 A 3/1999 Adams et al.
5,967,148 A 10/1999 Harris et al.
6,040,560 A 3/2000 Fleischhauer et al.
6,053,176 A 4/2000 Adams et al.
6,418,938 B1 7/2002 Fleischhauer et al.
6,532,965 B1 3/2003 Abhulimen et al.
6,615,840 B1 9/2003 Fournier et al.
6,810,883 B2 11/2004 Felter et al.
7,861,726 B1 1/2011 Lukasavitz
8,375,959 B2 2/2013 Dittrich et al.
8,419,085 B2 4/2013 Kim et al.
8,752,545 B2 6/2014 Buchberger
8,851,081 B2 10/2014 Fernando et al.
8,973,587 B2 3/2015 Liu
9,078,472 B2 7/2015 Liu
9,078,473 B2 7/2015 Worm et al.
9,220,304 B2 12/2015 Greim
9,271,528 B2 3/2016 Liu
9,320,299 B2 4/2016 Hearn et al.
9,423,152 B2 8/2016 Ampolini et al.
9,427,023 B2 8/2016 Liu
9,497,991 B2 11/2016 Besso et al.
9,499,332 B2 11/2016 Fernando et al.
9,504,279 B2 11/2016 Chen
9,516,899 B2 12/2016 Plojoux et al.
9,560,883 B2 2/2017 Hawes
9,603,388 B2 3/2017 Fernando et al.
9,655,383 B2 5/2017 Holzherr et al.
9,693,587 B2 7/2017 Plojoux et al.
9,723,871 B2 8/2017 Xiang
9,795,166 B2 10/2017 Liu
9,814,263 B2 11/2017 Cochand et al.
9,854,841 B2 1/2018 Ampolini et al.
9,854,845 B2 1/2018 Plojoux et al.
9,894,934 B2 2/2018 Li et al.
9,918,494 B2 3/2018 Mironov et al.
9,955,724 B2 5/2018 Lord
9,986,760 B2 6/2018 Macko et al.
9,999,247 B2 6/2018 Ruscio et al.
10,015,990 B2 7/2018 Mironov
10,031,183 B2 7/2018 Novak, III et al.
10,070,667 B2 9/2018 Lord et al.
10,104,911 B2 10/2018 Thorens et al.
10,130,780 B2 11/2018 Talon
10,136,673 B2 11/2018 Mironov
10,159,283 B2 12/2018 Mironov
10,194,697 B2 2/2019 Fernando et al.
10,299,513 B2 5/2019 Perez et al.
10,368,584 B2 8/2019 Fernando et al.
10,439,419 B2 10/2019 Bernauer et al.
10,440,987 B2 10/2019 Zeng et al.
10,448,670 B2 10/2019 Talon et al.
10,492,542 B1 12/2019 Worm et al.
10,548,350 B2 2/2020 Greim et al.
10,555,553 B2 2/2020 Binassi et al.
10,555,555 B2 2/2020 Fernando et al.
10,588,351 B2 3/2020 Ricketts
10,617,149 B2 4/2020 Malgat et al.
10,645,971 B2 5/2020 Zitzke
10,668,058 B2 6/2020 Rose et al.
10,716,329 B2 7/2020 Matsumoto et al.
10,757,975 B2 9/2020 Batista et al.
10,813,174 B2 10/2020 Schneider et al.
10,881,143 B2 1/2021 Suzuki et al.
11,039,642 B2 6/2021 Zuber et al.
11,147,316 B2 10/2021 Farine et al.
11,445,576 B2 9/2022 Zinovik et al.
2004/0261802 A1 12/2004 Griffin et al.
2005/0045198 A1 3/2005 Larson et al.
2005/0172976 A1 8/2005 Newman et al.
2006/0030214 A1 2/2006 Katou et al.
2008/0001052 A1 1/2008 Kalous et al.
2010/0001538 A1 1/2010 Kim et al.
2010/0024834 A1 2/2010 Oglesby et al.
2010/0307518 A1 12/2010 Wang
2011/0036346 A1* 2/2011 Cohen ..... A24F 40/60 128/200.14
2011/0155151 A1 6/2011 Newman et al.
2011/0209717 A1 9/2011 Han
2011/0226236 A1 9/2011 Buchberger
2011/0265806 A1 11/2011 Alarcon et al.
2011/0290248 A1 12/2011 Schennum
2011/0290269 A1 12/2011 Shimizu
2012/0048266 A1 3/2012 Alelov
2012/0247494 A1 10/2012 Oglesby et al.
2013/0014772 A1 1/2013 Liu
2013/0037041 A1 2/2013 Worm et al.
2013/0074857 A1 3/2013 Buchberger
2013/0213419 A1 8/2013 Tucker et al.
2013/0284192 A1 10/2013 Peleg et al.
2013/0319439 A1 12/2013 Gorelick et al.
2013/0319440 A1* 12/2013 Capuano ..... A61M 15/06 131/329
2013/0319999 A1 12/2013 Plojoux et al.
2013/0340775 A1 12/2013 Juster et al.
2014/0014125 A1 1/2014 Fernando et al.
2014/0020698 A1 1/2014 Fiebelkorn
2014/0096782 A1 4/2014 Ampolini et al.
2014/0116455 A1 5/2014 Youn
2014/0246035 A1 9/2014 Minskoff et al.
2014/0299137 A1 10/2014 Kieckbusch et al.
2014/0301721 A1 10/2014 Ruscio et al.
2014/0305448 A1 10/2014 Zuber et al.
2014/0318559 A1 10/2014 Thorens et al.
2014/0345633 A1 11/2014 Talon et al.
2014/0345634 A1 11/2014 Zuber et al.
2014/0363145 A1 12/2014 Plojoux et al.
2015/0007838 A1 1/2015 Fernando et al.
2015/0013696 A1 1/2015 Plojoux et al.
2015/0020832 A1 1/2015 Greim et al.
2015/0024355 A1 1/2015 Ghofrani et al.
2015/0027474 A1 1/2015 Zuber et al.
2015/0100441 A1 4/2015 Alarcon et al.
2015/0136124 A1 5/2015 Aronie et al.
2015/0136154 A1 5/2015 Mitrev et al.
2015/0201676 A1 7/2015 Shin
2015/0208725 A1 7/2015 Tsai
2015/0208730 A1 7/2015 Li et al.
2015/0245654 A1 9/2015 Memari et al.
2015/0245666 A1 9/2015 Memari et al.
2015/0257445 A1 9/2015 Henry, Jr. et al.
2015/0272211 A1 10/2015 Chung
2016/0057811 A1* 2/2016 Alarcon ..... A24F 40/50 219/494
2016/0150824 A1 6/2016 Memari et al.
2016/0205998 A1 7/2016 Matsumoto et al.
2016/0206003 A1* 7/2016 Yamada ..... H05B 3/0014
2016/0227840 A1* 8/2016 Xiang ..... A24F 40/51

(56) References Cited

U.S. PATENT DOCUMENTS

| | | | |
|---|---|---|---|
| 2016/0235121 | A1 | 8/2016 | Rogan et al. |
| 2016/0270437 | A1 | 9/2016 | Nappi |
| 2016/0286861 | A1 | 10/2016 | Liu |
| 2016/0302488 | A1 | 10/2016 | Fernando et al. |
| 2016/0031032 | A1 | 11/2016 | Malgat et al. |
| 2016/0331032 | A1 | 11/2016 | Malgat et al. |
| 2016/0345629 | A1 | 12/2016 | Mironov |
| 2016/0366946 | A1 | 12/2016 | Murison et al. |
| 2016/0374402 | A1 | 12/2016 | Fernando et al. |
| 2017/0006916 | A1 | 1/2017 | Liu |
| 2017/0006919 | A1 | 1/2017 | Liu |
| 2017/0027229 | A1 | 2/2017 | Cameron |
| 2017/0027234 | A1 | 2/2017 | Farine et al. |
| 2017/0042243 | A1 | 2/2017 | Plojoux et al. |
| 2017/0042251 | A1 | 2/2017 | Yamada et al. |
| 2017/0055580 | A1 | 3/2017 | Blandino et al. |
| 2017/0065002 | A1 | 3/2017 | Fernando et al. |
| 2017/0071251 | A1 | 3/2017 | Goch |
| 2017/0071259 | A1 | 3/2017 | Yamada et al. |
| 2017/0095006 | A1 | 4/2017 | Egoyants et al. |
| 2017/0150757 | A1 | 6/2017 | Worm et al. |
| 2017/0164659 | A1 | 6/2017 | Schneider et al. |
| 2017/0172214 | A1 | 6/2017 | Li et al. |
| 2017/0172215 | A1 | 6/2017 | Li et al. |
| 2017/0188634 | A1 | 7/2017 | Plojoux et al. |
| 2017/0238596 | A1 | 8/2017 | Matsumoto et al. |
| 2017/0295844 | A1 | 10/2017 | Thevenaz et al. |
| 2018/0146710 | A1* | 5/2018 | Bessant ..... H05B 1/0297 |
| 2018/0177234 | A1 | 6/2018 | Lee |
| 2018/0206556 | A1 | 7/2018 | Thorens et al. |
| 2018/0235283 | A1 | 8/2018 | Zuber et al. |
| 2019/0014826 | A1 | 1/2019 | Thorens et al. |
| 2019/0075849 | A1 | 3/2019 | Hawes |
| 2019/0320719 | A1 | 10/2019 | Liu et al. |
| 2019/0364975 | A1 | 12/2019 | Fernando et al. |
| 2020/0006950 | A1 | 1/2020 | Holzherr |
| 2020/0120983 | A1 | 4/2020 | Chen |
| 2020/0232766 | A1 | 7/2020 | Flick |
| 2020/0305508 | A1 | 10/2020 | Talon |
| 2020/0352224 | A1 | 11/2020 | Plojoux et al. |
| 2020/0413495 | A1 | 12/2020 | Schneider et al. |
| 2021/0000182 | A1 | 1/2021 | Ruscio et al. |
| 2021/0120875 | A1 | 4/2021 | Mironov |

FOREIGN PATENT DOCUMENTS

| | | | |
|---|---|---|---|
| CH | 310239 | A | 12/1955 |
| CN | 2146758 | Y | 11/1993 |
| CN | 1102964 | A | 5/1995 |
| CN | 1122213 | A | 5/1996 |
| CN | 1190335 | A | 8/1998 |
| CN | 1209731 | A | 3/1999 |
| CN | 2857109 | Y | 1/2007 |
| CN | 1973706 | A | 6/2007 |
| CN | 101043827 | A | 9/2007 |
| CN | 101444335 | A | 6/2009 |
| CN | 201491717 | U | 6/2010 |
| CN | 101940369 | A | 1/2011 |
| CN | 102006790 | A | 4/2011 |
| CN | 102109393 | A | 6/2011 |
| CN | 102326869 | A | 1/2012 |
| CN | 102438470 | A | 5/2012 |
| CN | 202407082 | U | 9/2012 |
| CN | 202774134 | U | 3/2013 |
| CN | 103096741 | A | 5/2013 |
| CN | 103281920 | A | 9/2013 |
| CN | 103338665 | A | 10/2013 |
| CN | 103622162 | A | 3/2014 |
| CN | 203457802 | U | 3/2014 |
| CN | 203575658 | U | 5/2014 |
| CN | 103859606 | A | 6/2014 |
| CN | 203633505 | U | 6/2014 |
| CN | 203646503 | U | 6/2014 |
| CN | 103929988 | A | 7/2014 |
| CN | 203689071 | U | 7/2014 |
| CN | 203692545 | U | 7/2014 |
| CN | 103974638 | A | 8/2014 |
| CN | 103974640 | A | 8/2014 |
| CN | 103987286 | A | 8/2014 |
| CN | 103997921 | A | 8/2014 |
| CN | 103997922 | A | 8/2014 |
| CN | 203789137 | U | 8/2014 |
| CN | 104023568 | A | 9/2014 |
| CN | 104023574 | A | 9/2014 |
| CN | 104039183 | A | 9/2014 |
| CN | 203814592 | U | 9/2014 |
| CN | 104095295 | A | 10/2014 |
| CN | 104106842 | A | 10/2014 |
| CN | 203943078 | U | 11/2014 |
| CN | 204070570 | U | 1/2015 |
| CN | 204146338 | U | 2/2015 |
| CN | 102811634 | B | 3/2015 |
| CN | 104382237 | A | 3/2015 |
| CN | 104470387 | A | 3/2015 |
| CN | 104489933 | A | 4/2015 |
| CN | 104544559 | A | 4/2015 |
| CN | 204317494 | U | 5/2015 |
| CN | 204317504 | U | 5/2015 |
| CN | 205197003 | U | 5/2015 |
| CN | 104754964 | A | 7/2015 |
| CN | 104770878 | A | 7/2015 |
| CN | 104799438 | A | 7/2015 |
| CN | 104812260 | A | 7/2015 |
| CN | 204444239 | U | 7/2015 |
| CN | 204763414 | U | 11/2015 |
| CN | 105163610 | A | 12/2015 |
| CN | 105208882 | A | 12/2015 |
| CN | 105208884 | A | 12/2015 |
| CN | 105341993 | A | 2/2016 |
| CN | 105357994 | A | 2/2016 |
| CN | 205018293 | U | 2/2016 |
| CN | 105361250 | A | 3/2016 |
| CN | 105453598 | A | 3/2016 |
| CN | 205072064 | U | 3/2016 |
| CN | 205180371 | U | 4/2016 |
| CN | 205337598 | U | 6/2016 |
| CN | 105747281 | A | 7/2016 |
| CN | 105789506 | A | 7/2016 |
| CN | 105831812 | A | 8/2016 |
| CN | 105848503 | A | 8/2016 |
| CN | 105876869 | A | 8/2016 |
| CN | 205456048 | U | 8/2016 |
| CN | 205512358 | U | 8/2016 |
| CN | 105939625 | A | 9/2016 |
| CN | 205597118 | U | 9/2016 |
| CN | 106037014 | A | 10/2016 |
| CN | 205648910 | U | 10/2016 |
| CN | 106102492 | A | 11/2016 |
| CN | 106132217 | A | 11/2016 |
| CN | 106163307 | A | 11/2016 |
| CN | 205728067 | U | 11/2016 |
| CN | 106174699 | A | 12/2016 |
| CN | 106231934 | A | 12/2016 |
| CN | 205831062 | U | 12/2016 |
| CN | 106413439 | A | 2/2017 |
| CN | 106413444 | A | 2/2017 |
| CN | 106455708 | A | 2/2017 |
| CN | 106455714 | A | 2/2017 |
| CN | 106455716 | A | 2/2017 |
| CN | 106473233 | A | 3/2017 |
| CN | 106535680 | A | 3/2017 |
| CN | 206097720 | U | 4/2017 |
| CN | 206197012 | U | 5/2017 |
| CN | 106901404 | A | 6/2017 |
| CN | 206312988 | U | 7/2017 |
| CN | 105342011 | B | 6/2018 |
| DE | 3302518 | A1 | 7/1984 |
| DE | 20 2014 004 361 | U1 | 9/2015 |
| EA | 012169 | B1 | 8/2009 |
| EA | 026076 | B1 | 2/2017 |
| EP | 1119267 | B1 | 7/2004 |
| EP | 2 110 033 | A | 10/2009 |
| EP | 2113178 | A1 | 11/2009 |
| EP | 2 201 850 | A1 | 6/2010 |

(56) References Cited

FOREIGN PATENT DOCUMENTS

| | | | |
|---|---|---|---|
| EP | 2253233 | A1 | 11/2010 |
| EP | 2316286 | A1 | 5/2011 |
| EP | 2022349 | B1 | 7/2014 |
| EP | 2 531 053 | B1 | 9/2015 |
| EP | 3 098 738 | A1 | 11/2016 |
| EP | 2 432 339 | B1 | 3/2017 |
| EP | 3 179 828 | A1 | 6/2017 |
| EP | 3 275 319 | B1 | 8/2020 |
| GB | 2542018 | A | 3/2017 |
| GB | 2550540 | A | 11/2017 |
| JP | 3-232481 | A | 10/1991 |
| JP | 7-184627 | A | 7/1995 |
| JP | 11-40122 | A | 2/1999 |
| JP | 11-164679 | A | 6/1999 |
| JP | 3645921 | B2 | 5/2005 |
| JP | 2006-92831 | A | 4/2006 |
| JP | 2006-320286 | A | 11/2006 |
| JP | 4278306 | B2 | 6/2009 |
| JP | 2010-178730 | A | 8/2010 |
| JP | 2010-526553 | A | 8/2010 |
| JP | 2011-87569 | A | 5/2011 |
| JP | 2011-518567 | A | 6/2011 |
| JP | 4739433 | B2 | 8/2011 |
| JP | 2012-527222 | A | 11/2012 |
| JP | 2014-500017 | A | 1/2014 |
| JP | 2014-79229 | A | 5/2014 |
| JP | 2014-521419 | A | 8/2014 |
| JP | 2014-525237 | A | 9/2014 |
| JP | 2014-533513 | A | 12/2014 |
| JP | 2014-534813 | A | 12/2014 |
| JP | 2015-503916 | A | 2/2015 |
| JP | 2015-504669 | A | 2/2015 |
| JP | 2015-506170 | A | 3/2015 |
| JP | 2015-507477 | A | 3/2015 |
| JP | 2015-508996 | A | 3/2015 |
| JP | 2015-524261 | A | 8/2015 |
| JP | 2015-180214 | A | 10/2015 |
| JP | 2015-529458 | A | 10/2015 |
| JP | 2015-204833 | A | 11/2015 |
| JP | 2016-528910 | A | 9/2016 |
| JP | 3207506 | U | 11/2016 |
| JP | 2016-538848 | A | 12/2016 |
| JP | 2017-501682 | A | 1/2017 |
| JP | 2017-46700 | A | 3/2017 |
| JP | 2017-51189 | A | 3/2017 |
| JP | 2017-70297 | A | 4/2017 |
| JP | 2017-514463 | A | 6/2017 |
| KR | 10-0304044 | B1 | 11/2001 |
| KR | 10-0636287 | B1 | 10/2006 |
| KR | 10-0806461 | B1 | 2/2008 |
| KR | 20-2009-0008911 | U | 9/2009 |
| KR | 10-0965099 | B1 | 6/2010 |
| KR | 10-1001077 | B1 | 12/2010 |
| KR | 10-2011-0096548 | A | 8/2011 |
| KR | 20-2011-0009632 | U | 10/2011 |
| KR | 10-1098112 | B1 | 12/2011 |
| KR | 10-2012-0027029 | A | 3/2012 |
| KR | 10-2012-0101637 | A | 9/2012 |
| KR | 10-1184499 | B1 | 9/2012 |
| KR | 10-2012-0109634 | A | 10/2012 |
| KR | 10-2012-0114333 | A | 10/2012 |
| KR | 10-2012-0121314 | A | 11/2012 |
| KR | 10-2013-0027909 | A | 3/2013 |
| KR | 20-0466757 | Y1 | 5/2013 |
| KR | 10-2013-0081238 | A | 7/2013 |
| KR | 20-0469513 | Y1 | 10/2013 |
| KR | 10-2013-0139296 | A | 12/2013 |
| KR | 10-2014-0015774 | A | 2/2014 |
| KR | 10-1383577 | B1 | 4/2014 |
| KR | 10-2014-0068203 | A | 6/2014 |
| KR | 10-2014-0092312 | A | 7/2014 |
| KR | 10-2014-0114554 | A | 9/2014 |
| KR | 10-2014-0116055 | A | 10/2014 |
| KR | 10-2014-0118983 | A | 10/2014 |
| KR | 10-2014-0119072 | A | 10/2014 |
| KR | 10-2014-0135774 | A | 11/2014 |
| KR | 20-2014-0006242 | U | 12/2014 |
| KR | 10-2015-0030409 | A | 3/2015 |
| KR | 10-2015-0033617 | A | 4/2015 |
| KR | 10-2015-0058569 | A | 5/2015 |
| KR | 10-1516304 | B1 | 5/2015 |
| KR | 10-1523088 | B1 | 5/2015 |
| KR | 10-1523088 | B2 | 5/2015 |
| KR | 10-2015-0099704 | A | 9/2015 |
| KR | 10-2015-0099771 | A | 9/2015 |
| KR | 10-2016-0009678 | A | 1/2016 |
| KR | 10-2016-0012110 | A | 2/2016 |
| KR | 10-2016-0012329 | A | 2/2016 |
| KR | 10-2016-0015144 | A | 2/2016 |
| KR | 10-2016-0040643 | A | 4/2016 |
| KR | 10-1609715 | B1 | 4/2016 |
| KR | 10-2016-0052607 | A | 5/2016 |
| KR | 10-2016-0060006 | A | 5/2016 |
| KR | 10-1619032 | B1 | 5/2016 |
| KR | 20-2016-0001476 | U | 5/2016 |
| KR | 10-2016-0088163 | A | 7/2016 |
| KR | 10-2016-0094938 | A | 8/2016 |
| KR | 10-2016-0096744 | A | 8/2016 |
| KR | 10-2016-0108855 | A | 9/2016 |
| KR | 10-1656061 | B1 | 9/2016 |
| KR | 10-2016-0114743 | A | 10/2016 |
| KR | 10-2016-0124091 | A | 10/2016 |
| KR | 10-1667124 | B1 | 10/2016 |
| KR | 10-1668175 | B1 | 10/2016 |
| KR | 10-2016-0129024 | A | 11/2016 |
| KR | 10-2016-0131035 | A | 11/2016 |
| KR | 10-2016-0133665 | A | 11/2016 |
| KR | 10-2016-0137627 | A | 11/2016 |
| KR | 10-1679489 | B1 | 11/2016 |
| KR | 10-2016-0140608 | A | 12/2016 |
| KR | 10-2016-0142896 | A | 12/2016 |
| KR | 10-2016-0147253 | A | 12/2016 |
| KR | 10-1690389 | B1 | 12/2016 |
| KR | 10-2017-0006282 | A | 1/2017 |
| KR | 10-2017-0007262 | A | 1/2017 |
| KR | 10-2017-0044158 | A | 4/2017 |
| KR | 10-2017-0071486 | A | 6/2017 |
| KR | 10-2017-0074898 | A | 6/2017 |
| KR | 10-1740160 | B1 | 6/2017 |
| RU | 2302806 | C2 | 7/2007 |
| RU | 2425608 | C2 | 8/2011 |
| RU | 2 531 890 | C2 | 10/2014 |
| RU | 2564600 | C1 | 10/2015 |
| RU | 2014 125 232 | A | 12/2015 |
| RU | 2581999 | C2 | 4/2016 |
| RU | 2589437 | C2 | 7/2016 |
| RU | 2594557 | C2 | 8/2016 |
| RU | 2595593 | C2 | 8/2016 |
| RU | 2 602 053 | C2 | 11/2016 |
| RU | 2 602 962 | C2 | 11/2016 |
| RU | 2 603 559 | C2 | 11/2016 |
| RU | 2 604 012 | C2 | 12/2016 |
| RU | 2604012 | C2 | 12/2016 |
| UA | 104628 | C2 | 2/2014 |
| UA | 112169 | C2 | 8/2016 |
| WO | 94/06314 | A1 | 3/1994 |
| WO | 98/23171 | A1 | 6/1998 |
| WO | 0027232 | A1 | 5/2000 |
| WO | 2010/133342 | A1 | 11/2010 |
| WO | 2011/028372 | A1 | 3/2011 |
| WO | 2011/050964 | A1 | 5/2011 |
| WO | 2011/095781 | A1 | 8/2011 |
| WO | 2012/072264 | A1 | 6/2012 |
| WO | 2012/123702 | A1 | 9/2012 |
| WO | 2013/034458 | A1 | 3/2013 |
| WO | 2013/060743 | A2 | 5/2013 |
| WO | 2013/076098 | A2 | 5/2013 |
| WO | 2013/093695 | A1 | 6/2013 |
| WO | 2013/098395 | A1 | 7/2013 |
| WO | 2013/098398 | A3 | 7/2013 |
| WO | 2013/098409 | A1 | 7/2013 |
| WO | 2013/102609 | A2 | 7/2013 |
| WO | 2013/102612 | A2 | 7/2013 |
| WO | 2013102609 | A2 | 7/2013 |

(56) References Cited

FOREIGN PATENT DOCUMENTS

| | | | |
|---|---|---|---|
| WO | 2013/120565 | A3 | 8/2013 |
| WO | 2013/126777 | A2 | 8/2013 |
| WO | 2013/137084 | A1 | 9/2013 |
| WO | 2013/171217 | A1 | 11/2013 |
| WO | 2013/190036 | A1 | 12/2013 |
| WO | 2014/029880 | A2 | 2/2014 |
| WO | 2014/102092 | A1 | 7/2014 |
| WO | 2015/046386 | A1 | 4/2015 |
| WO | 2015/088744 | A1 | 6/2015 |
| WO | 2015/128665 | A1 | 9/2015 |
| WO | 2015155289 | A1 | 10/2015 |
| WO | 2015/165813 | A1 | 11/2015 |
| WO | 2015/174657 | A1 | 11/2015 |
| WO | 2015/177044 | A1 | 11/2015 |
| WO | 2015197627 | A1 | 12/2015 |
| WO | 2016/059073 | A1 | 4/2016 |
| WO | 2016/075028 | A1 | 5/2016 |
| WO | 2016/076147 | A1 | 5/2016 |
| WO | 2016/107766 | A1 | 7/2016 |
| WO | 2016/124550 | A1 | 8/2016 |
| WO | 2016/124552 | A1 | 8/2016 |
| WO | 2016/150019 | A1 | 9/2016 |
| WO | 2016/156103 | A1 | 10/2016 |
| WO | 2016/156219 | A1 | 10/2016 |
| WO | 2016/159013 | A1 | 10/2016 |
| WO | 2016/166064 | A1 | 10/2016 |
| WO | 2016/178377 | A1 | 11/2016 |
| WO | 2016/187803 | A1 | 12/2016 |
| WO | 2017/029088 | A1 | 2/2017 |
| WO | 2017/029089 | A1 | 2/2017 |
| WO | 2017/037457 | A1 | 3/2017 |
| WO | 2017/042297 | A1 | 3/2017 |
| WO | 2017/075759 | A1 | 5/2017 |
| WO | 2017/139963 | A1 | 8/2017 |
| WO | 2018/050449 | A1 | 3/2018 |
| WO | 2018/189195 | A1 | 10/2018 |
| WO | 2019/020826 | A1 | 1/2019 |
| WO | 2019/030172 | A1 | 2/2019 |
| WO | 2019/095268 | A1 | 5/2019 |

OTHER PUBLICATIONS

Extended European Search Report dated Apr. 1, 2021 in European Application No. 18805933.1.
Extended European Search Report dated Jan. 15, 2021 in European Application No. 20188949.0.
Extended European Search Report dated Jul. 1, 2021 in European Application No. 18854661.8.
Extended European Search Report dated Jun. 14, 2021 in European Application No. 18842951.8.
Extended European Search Report dated Jun. 16, 2021 in European Application No. 18853434.1.
International Search Report dated Aug. 29, 2018 in International Application No. PCT/KR2018/005945.
International Search Report dated Dec. 4, 2018 in International Application No. PCT/KR2018/006747.
International Search Report dated Feb. 28, 2019 in International Application No. PCT/KR2018/009100.
International Search Report dated Nov. 26, 2018 in International Application No. PCT/KR2018/009094.
International Search Report dated Nov. 30, 2018 in International Application No. PCT/KR2018/006702.
International Search Report issued Nov. 6, 2018 in International Application No. PCT/KR2018/004129.
Office Action dated Apr. 25, 2019 in Korean Application No. 10-2019-0033784.
Office Action dated Apr. 4, 2019 in Korean Application No. 10-2019-0019194.
Office Action dated Apr. 4, 2019 in Korean Application No. 10-2019-0019195.
Office Action dated Apr. 5, 2019 in Korean Application No. 10-2019-0027638.
Office Action dated Apr. 9, 2021 in Korean Application No. 10-2020-0116256.
Office Action dated Jun. 10, 2021 in Russian Application No. 2020124657.
Office Action dated Jun. 10, 2021 in Russian Application No. 2020124658.
Office Action dated Jun. 29, 2021 in Chinese Application No. 201880022072.2.
Office Action dated May 5, 2021 in Canadian Application No. 3,047,236.
International Search Report dated Jul. 24, 2018 in International Application No. PCT/KR2018/003691.
Office Action dated Jul. 2, 2019 in Korean Application No. 10-2019-0018815.
Office Action dated Jul. 3, 2019 in Korean Application No. 10-2019-0017391.
International Search Report dated Oct. 29, 2018 in International Application No. PCT/KR2018/004181.
International Search Report dated Sep. 6, 2018 in International Application No. PCT/KR2018/004179.
International Search Report dated Nov. 6, 2018 in International Application No. PCT/KR2018/004178.
International Search Report dated Sep. 6, 2018 in International Application No. PCT/KR2018/004176.
International Search Report dated Sep. 7, 2018 in International Application No. PCT/KR2018/004172.
International Search Report dated Sep. 7, 2018 in International Application No. PCT/KR2018/004171.
International Search Report dated Nov. 6, 2018 in International Application No. PCT/KR2018/004130.
International Search Report dated Nov. 6, 2018 in International Application No. PCT/KR2018/004129.
International Search Report dated Nov. 14, 2018 in International Application No. PCT/KR2018/004118.
International Search Report dated May 29, 2018 in International Application No. PCT/KR2017/012486.
Extended European Search Report dated Dec. 11, 2020 in European Application No. 20188967.2.
Extended European Search Report dated Dec. 16, 2020 in European Application No. 20188985.4.
Office Action dated Dec. 30, 2020 in Russian Application No. 2020124651.
Office Action dated Dec. 28, 2020 in Russian Application No. 2020124652.
Office Action dated Dec. 11, 2020 in Russian Application No. 2020124653.
Office Action dated Jan. 22, 2021 in Russian Application No. 2020124657.
Office Action dated Jan. 22, 2021 in Russian Application No. 2020124658.
Extended European Search Report dated Dec. 18, 2020 in European Application No. 18775504.6.
Office Action dated Jan. 19, 2021 in Japanese Application No. 2019-553569.
Extended European Search Report dated Jan. 14, 2021 in European Application No. 18784738.9.
Extended European Search Report dated Dec. 10, 2020 in European Application No. 20188932.6.
Office Action dated Jan. 12, 2021 in Japanese Application No. 2019-555201.
Office Action dated Jan. 12, 2021 in Japanese Application No. 2019-555169.
Office Action dated Jan. 5, 2021 in Japanese Application No. 2019-558557.
Extended European Search Report dated Nov. 19, 2020 in European Application No. 20188792.4.
Office Action dated Dec. 1, 2020 in Japanese Application No. 2020-501188.
Extended European Search Report dated Dec. 18, 2020 in European Application No. 20188926.8.
Office Action dated Jan. 19, 2021 in Japanese Application No. 2020-501514.

(56) References Cited

OTHER PUBLICATIONS

Office Action dated Sep. 24, 2020 in Korean Application No. 10-2018-0012456.
Office Action dated May 28, 2020 in Korean Application No. 10-2017-0147605.
Office Action dated Nov. 14, 2019 in Korean Application No. 10-2017-0084385.
Office Action dated Nov. 14, 2019 in Korean Application No. 10-2017-0147605.
Office Action dated Jul. 27, 2021 in Chinese Patent Application No. 201780084891.5.
Office Action dated Aug. 16, 2021 in Chinese Patent Application No. 201880024006.9.
Office Action dated Aug. 26, 2021 in Chinese Patent Application No. 201880024107.6.
Office Action dated Aug. 4, 2021 in Chinese Patent Application No. 201880024289.7.
Office Action dated Jul. 26, 2021 in Chinese Patent Application No. 201880024059.0.
Office Action dated Jul. 16, 2021 in Chinese Patent Application No. 201880024367.3.
Office Action dated Jul. 19, 2021 Chinese Patent Application No. 201880024070.7.
Office Action dated Sep. 17, 2021 in Chinese Patent Application No. 201880030699.2.
Extended European Search Report dated Jan. 14, 2021 in European Application No. 18783776.0.
Extended European Search Report dated Jan. 25, 2021 in European Application No. 18785166.2.
Extended European Search Report dated Jan. 29, 2021 in European Application No. 18784464.2.
Extended European Search Report dated Mar. 15, 2021 in European Application No. 18785061.5.
Extended European Search Report dated Mar. 19, 2021 in European Application No. 18784164.8.
Extended European Search Report dated Mar. 24, 2021 in European Application No. 18784268.7.
Extended European Search Report dated Mar. 25, 2021 in European Application No. 18784370.1.
Extended European Search Report dated Mar. 25, 2021 in European Application No. 18784841.1.
Office Action dated Feb. 24, 2021 in Japanese Application No. 2019-555168.
Office Action dated Feb. 24, 2021 in Japanese Application No. 2019-555203.
Office Action dated Feb. 24, 2021 in Japanese Application No. 2019-555204.
Office Action dated Feb. 4, 2021 in Russian Application No. 2020124609.
Office Action dated Feb. 9, 2021 in Japanese Application No. 2019-555184.
Office Action dated Jan. 26, 2021 in Japanese Application No. 2020-501521.
Office Action dated Mar. 2, 2021 in Japanese Application No. 2019-555170.
Office Action dated Mar. 2, 2021 in Japanese Application No. 2019-555182.
Office Action dated Mar. 30, 2021 in Japanese Application No. 2020-501377.
Office Action dated Jan. 19, 2021 in Indonesian Application No. P00201906007.
Office Action dated Dec. 11, 2019 in Korean Application No. 10-2018-0010836.
Office Action dated Dec. 11, 2019 in Korean Application No. 10-2018-0010841.
Office Action dated Dec. 19, 2019 in Korean Application No. 10-2018-0090910.
Office Action dated Jan. 3, 2020 in Korean Application No. 10-2018-0012456.
Office Action dated Jan. 3, 2020 in Korean Application No. 10-2017-0084389.
Office Action dated Jan. 3, 2020 in Korean Application No. 10-2017-0084386.
Office Action dated Jan. 3, 2020 in Korean Application No. 10-2018-0018693.
Office Action dated Jan. 8, 2020 in Korean Application No. 10-2017-0128293.
Office Action dated Jan. 8, 2020 in Korean Application No. 10-2017-0119664.
Office Action dated Jan. 16, 2020 in Korean Application No. 10-2017-0084388.
Office Action dated Jan. 16, 2020 in Korean Application No. 10-2017-0084387.
Office Action dated Feb. 11, 2020 in Korean Application No. 10-2018-0010834.
Office Action dated Feb. 11, 2020 in Korean Application No. 10-2018-0010835.
Office Action dated Feb. 13, 2020 in Korean Application No. 10-2018-0010837.
Office Action dated Feb. 18, 2020 in Russian Application No. 2019121813.
Office Action dated Aug. 7, 2019 for Korean Patent Application No. 10-2018-0067035, and its English translation provided by Applicants foreign counsel.
Office Action dated Jun. 27, 2019 for Korean Patent Application No. 10-2018-0063759, and its English translation provided by Applicants foreign counsel.
Office Action dated Jul. 2, 2019 for Korean Patent Application No. 10-2019-0018815, and its English translation provided by Applicants foreign counsel.
Office Action dated Jul. 3, 2019 for Korean Patent Application No. 10-2019-0017391, and its English translation provided by Applicants foreign counsel.
International Preliminary Report on Patentability (Chapter I) dated Jun. 18, 2019 for PCT/KR2017/012486 and its English translation from WIPO.
Written Opinion of the International Searching Authority for PCT/KR2017/012486 dated May 29, 2018 and its English translation by Google Translate (now published as WO 2018/110834).
Partial supplementary European search report dated Aug. 3, 2020 in Application No. 17880867.1.
Extended European search report dated Nov. 4, 2020 by the European Patent Office in Application No. 17880867.1.
Office Action dated Oct. 29, 2020 by the Korean Patent Office in Application No. 10-2018-0010837.
Office Action dated Nov. 4, 2020 by the Japanese Patent Office in Application No. 2019-554453.
Office Action dated Nov. 4, 2020 by the Japanese Patent Office in Application No. 2020-128346.
Decision on Grant dated Nov. 26, 2020 by the Russian Federal Service For Intellectual Property Patent Application No. 2020124607.
Office Action dated Nov. 26, 2020 by Russian Federal Service For Intellectual Property Office Patent Application No. 2020124609.
Decision on Grant dated Oct. 26, 2020 by Russian Federal Service For Intellectual Property in Application No. 2020124610.
Office Action dated Jun. 29, 2020 by the Korean Patent Office in Application No. 10-2018-0010836.
Extended European Search Report dated Oct. 27, 2021 in European Application No. 18844735.3.
Office Action dated Oct. 28, 2021 in Chinese Application No. 201880046418.2.
Office Action dated Sep. 24, 2021 in Chinese Application No. 201880024010.5.
Office Action dated Sep. 29, 2021 in Chinese Application No. 201880024276.X.
Office Action dated Sep. 29, 2021 in Chinese Application No. 201880024311.8.
Office Action dated Nov. 25, 2021 in Chinese Application No. 201880047174.X.
Office Action dated Dec. 1, 2021 in Chinese Application No. 201880046367.3.

(56) References Cited

OTHER PUBLICATIONS

Communication dated Mar. 14, 2022 from the Chinese Patent Office in Chinese Application No. 201880024059.0.
Communication dated Feb. 28, 2022 from the Chinese Patent Office in Chinese Application No. 201880050526.7.
Office Action dated Sep. 20, 2022 issued in Japanese Application No. 2021-174035.
Office Action dated Aug. 12, 2022 issued in Chinese Application No. 201880024059.0.
Office Action dated Oct. 24, 2022 from the Ukrainian Patent Office in UA Application No. a202004868.
Office Action dated Oct. 27, 2022 from the Ukrainian Patent Office in UA Application No. a202004869.
Office Action dated Nov. 22, 2022 from the China National Intellectual Property Administration in CN Application No. 202010762996.5.
Office Action dated Nov. 2, 2022 from the China National Intellectual Property Administration in CN Application No. 201880050526.7.
Office Action dated Dec. 30, 2022 2022 from the China National Intellectual Property Administration in CN Application No. 202010756239.7.
Office Action dated Dec. 13, 2022 from the Japanese Patent Office in JP Application No. 2021-165298.
Notice of Reasons for Refusal dated Jun. 28, 2022 from the Japanese Patent Office in Japanese Application No. 2021-075028.
Communication dated Jun. 9, 2022 from the Philippine Patent Office in Philippine Application No. 1-2019-501361.
Communication dated May 30, 2022 from the Canadian Patent Office in Canadian Application No. 3080145.
Office Action dated Jan. 10, 2023, issued in Chinese Application No. 202010760990.4.
Office Action dated Jan. 3, 2023, issued in Chinese Application No. 202010760979.8.
Office Action dated Jan. 28, 2023, issued in Chinese Application No. 202010763214.X.
Office Action dated Jan. 10, 2023, issued in Japanese Application No. 2021-177649.
Office Action dated Jun. 1, 2023 in Korean Application No. 10-2022-0148790.
Office Action dated Jul. 12, 2023 in Ukrainian Application No. a 2021 04884.
Office Action dated May 9, 2023 in Japanese Application No. 2022-086448.
Communication dated Jul. 10, 2023 in European Application No. 18 785 166.2.
Third Office Action issued in the China National Intellectual Property Administration dated Jul. 31, 2023 in corresponding Chinese Patent Application No. 201880050526.7.

* cited by examiner

AEROSOL GENERATING DEVICE AND METHOD FOR PROVIDING SMOKING RESTRICTION FUNCTION IN AEROSOL GENERATING DEVICE

CROSS REFERENCE TO RELATED APPLICATIONS

This application is a National Stage of International Application No. PCT/KR2018/004129, filed Apr. 9, 2018, claiming priorities to Korean Patent Application No. 10-2017-0046938 filed Apr. 11, 2017, Korean Patent Application No. 10-2017-0077586 filed Jun. 19, 2017 and Korean Patent Application No. 10-2017-0084386 filed Jul. 3, 2017.

TECHNICAL FIELD

The present disclosure relates to an aerosol generating apparatus having a smoking restriction function, and a method, performed by the aerosol generating apparatus, of providing the smoking restriction function.

BACKGROUND ART

In existing smoking products, a method of generating aerosol by directly burning an aerosol generating material during use has been used. However, when an aerosol generating material is directly burned, unwanted volatile compounds are generated, and thus health problems may occur. Accordingly, recently various aerosol generating apparatuses have been developed that electrically heat rather than burn an aerosol generating material, while significantly reducing the generation of unwanted volatile compounds and providing the flavor of a cigarette unchanged.

DESCRIPTION OF EMBODIMENTS

Technical Problem

Provided are an aerosol generating apparatus having a smoking restriction function, and a method, performed by the aerosol generating apparatus, of providing the smoking restriction function. Additional aspects will be set forth in part in the description which follows and, in part, will be apparent from the description, or may be learned by practice of the presented embodiments.

Solution to Problem

According to an aspect of the present disclosure, an aerosol generating apparatus includes a memory storing data about a smoking pattern of a user; an interface configured to receive a smoking initiation request from the user; a controller configured to determine whether the received smoking initiation request satisfies a smoking restriction condition for restricting smoking, based on the data about the smoking pattern; and a heater that receives, from a battery, power for generating aerosol or is restricted in terms of supply of the power under the control of the controller, according to whether the smoking restriction condition is satisfied.

According to another aspect of the present disclosure, a method of providing a smoking restriction function in an aerosol generating apparatus includes monitoring a smoking pattern of a user; receiving a smoking initiation request from the user; determining whether the received smoking initiation request satisfies a smoking restriction condition for restricting smoking, based on the monitoring of the smoking pattern; and controlling a heater to receive, from a battery, power for generating aerosol or to be restricted in terms of supply of the power, according to whether the smoking restriction condition is satisfied

Advantageous Effects of Disclosure

According to the above descriptions, a smoking behavior of a user may be appropriately controlled by using data about a smoking pattern of the user.

BEST MODE

Figure 1:
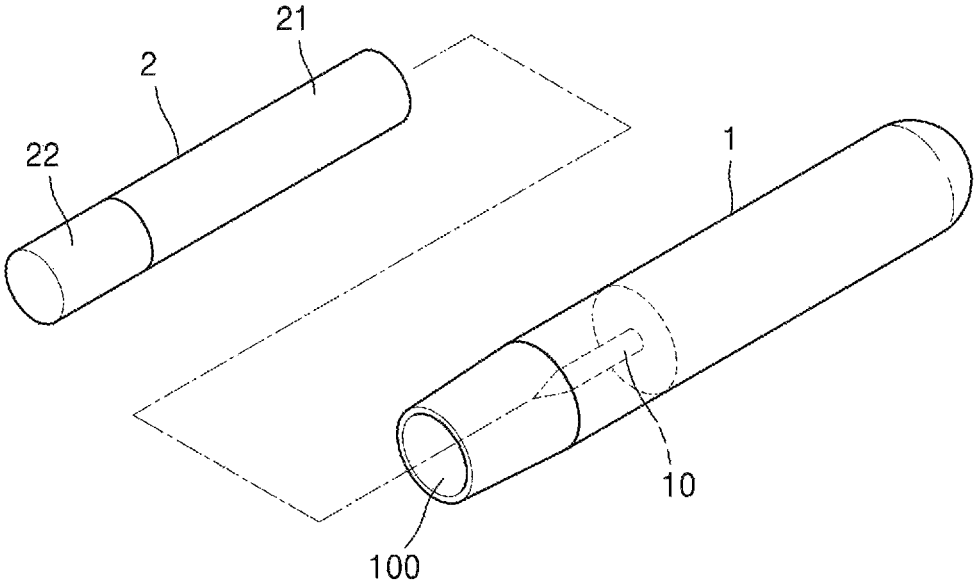
FIG. 1 is a diagram for explaining an aerosol generating apparatus and use of a cigarette, according to an embodiment.

According to an aspect of the present disclosure, there is provided an aerosol generating apparatus including: a memory storing data about a smoking pattern of a user; an interface configured to receive a smoking initiation request from the user; a controller configured to determine whether the received smoking initiation request satisfies a smoking restriction condition for restricting smoking, based on the data about the smoking pattern; and a heater that receives, from a battery, power for generating aerosol or is restricted in terms of supply of the power under the control of the controller, according to whether the smoking restriction condition is satisfied.

Mode of Disclosure

Although general terms widely used at present were selected for describing the present disclosure in consideration of the functions thereof, these general terms may vary according to intentions of one of ordinary skill in the art, case precedents, the advent of new technologies, or the like. Terms arbitrarily selected by the applicant of the disclosure may also be used in a specific case. In this case, their meanings need to be given in the detailed description. Hence, the terms must be defined based on their meanings and the contents of the entire specification, not by simply stating the terms.

Throughout the specification, when an element is referred to as being "connected" or "coupled" to another element, it can be directly connected or coupled to the other element, or can be electrically connected or coupled to the other element with intervening elements interposed therebetween. The terms "comprises" and/or "comprising" or "includes" and/or "including" when used in this specification, specify the presence of stated elements, but do not preclude the presence or addition of one or more other elements. In addition, terms such as " . . . unit" or the like refer to units that perform at least one function or operation, and the units may be implemented as hardware or software or as a combination of hardware and software.

In embodiments below, an "aerosol generating material" may mean a material capable of generating aerosol or may mean an aerosol forming material. Aerosol may include volatile compounds. The aerosol generating material may be solid or liquid.

For example, the solid aerosol generating material may include a solid material based on a tobacco raw material, such as a tobacco sheet, shredded tobacco, reconstituted tobacco, etc., and the liquid aerosol generating material may include a liquid material based on nicotine, tobacco extract and various flavoring agents. Of course, embodiments are not limited thereto.

In embodiments below, an aerosol generating apparatus may be an apparatus that generates aerosol by using an aerosol generating material to generate aerosol capable of being directly inhaled into the user's lung through the user's mouth. For example, the aerosol generating apparatus may be a holder. Hereinafter, the term 'aerosol generating apparatus' and the term 'holder (or holder device)' may indicate the same object.

In embodiments below, a "puff" means an action of inhaling an aerosol generating material (e.g., a cigarette) once by using an aerosol generating apparatus.

In embodiments below, "smoking" means consumption of one cigarette by using an aerosol generating apparatus. Thus, one-time smoking may mean smoking completed through several puffing actions.

Embodiments will now be described in detail with reference to the accompanying drawings.

FIG. 1 is a diagram for explaining an aerosol generating apparatus 1 and use of a cigarette, according to an embodiment.

Referring to FIG. 1, the aerosol generating apparatus 1 may be manufactured as a holder having the appearance of an elongate stick. A user may use the aerosol generating apparatus 1 by inserting the aerosol generating apparatus 1 between fingers, like existing general cigarettes.

The aerosol generating apparatus 1 includes a heater 10 that is electrically heated by power supplied by a battery. The heater 10 is fixed to be located within an empty space (or cavity) 100 formed on one end of the aerosol generating apparatus 1. A cigarette 3 may be accommodated in the empty space 100 of the aerosol generating apparatus 1. When the cigarette 3 is accommodated in the empty space 100, the heater 10 may penetrate through the aerosol generating material 21 provided on one end of the cigarette 3. The cigarette 3 may be used as various terms, such as a tobacco and a heat stick. The cigarette 3 is a smoking product including the aerosol generating material 21 packaged on an end and a filter 22 provided on the other end. The aerosol generating material 21 and the filter 22 are surrounded by a wrapper to contact each other.

When the cigarette 3 is inserted into the empty space 100 of the aerosol generating apparatus 1, the aerosol generating apparatus 1 heats the heater 10. The temperature of the aerosol generating material 21 in the cigarette 3 is raised by the heated heater 10, and thus aerosol is generated. The generated aerosol may be transferred to the user via the filter 22 of the cigarette 3. The heater 10 heats the aerosol generating material 21 to a temperature where the aerosol generating material 2 is not combusted.

The heater 10 is electrically heated by the power supplied by the battery. The heater 10 of FIG. 1 may be in the form of a needle in which one end inserted into the aerosol generating material 21 is formed to have an acute angle. However, embodiments are not limited thereto, and the heater 10 may be implemented in various types such as a tubular heater and a plurality of needle heaters, and one end of the heater 10 may be implemented to have a round shape instead of a pointed shape. In other words, the heater 10 may be any type as long as it is able to heat the aerosol generating material 21 of the cigarette 3 to no more than a combustion temperature so that aerosol may be generated.

Figure 2:
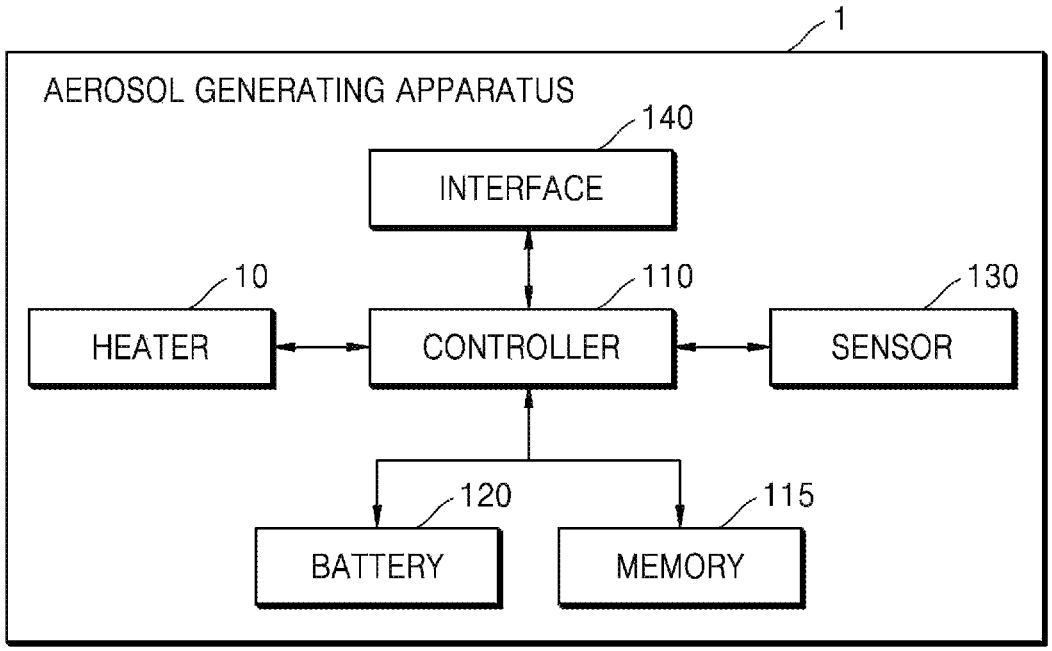
FIG. 2 is a block diagram illustrating a hardware structure of an aerosol generating apparatus, according to an embodiment.

FIG. 2 is a block diagram illustrating a hardware structure of the aerosol generating apparatus 1, according to an embodiment.

Referring to FIG. 2, the aerosol generating apparatus 1 may include the heater 10, a controller 120, a memory 115, a battery 110, a sensor 130, and an interface 140. However, it may be understood by one of ordinary skill in the art that the aerosol generating apparatus 1 may be implemented by further including other general-use components in addition to the components of FIG. 2 or by omitting some of the components of FIG. 2.

The heater 10 may be electrically heated by power supplied by the battery 110 under the control of the controller 120. The heater 10 may be an electro-resistive heater. For example, the heater 10 includes an electrically conductive track, and the heater 10 may be heated as a current flows through the electrically conductive track. When power is supplied to the heater 10, the surface temperature of the heater 10 may rise to 400° C. or higher. The surface temperature of the heater 10 may rise to about 350° C. before a certain time period (e.g., 15 seconds) after the power starts being supplied to the heater 10 starts.

The controller 120 is hardware that controls all operations of the aerosol generating apparatus 1. The controller 120 is an integrated circuit implemented by using a processing unit such as a microprocessor or a microcontroller.

The controller 120 analyzes a result of the sensing by the sensor 130, and controls processes that are to be performed subsequently. The controller 120 may resume or interrupt supply of power from the battery 110 to the heater 10, according to the result of the sensing. The controller 120 may control the amount of power supplied to the heater 10 and a time period during which power is supplied, such that the heater 10 may be heated to a predetermined temperature or maintained at a proper temperature. Furthermore, the controller 120 may process various pieces of input information and output information of the interface 140.

The controller 120 may count the number of times a user smokes by using the aerosol generating apparatus 1, and may control related functions of the aerosol generating apparatus 1 to restrict smoking of the user according to a result of the counting. This will be described in more detail later with corresponding drawings below.

The memory 115 may store data about a smoking pattern of the user, such as a smoking time and the number of times of smoking. The memory 115 is hardware for storing various kinds of data processed in the aerosol generating apparatus 1. For example, the memory 115 may store data that have been processed and are to be processed in the controller 120. The memory 115 may be implemented by using any of various types such as random access memory (RAM) (e.g., dynamic random access memory (DRAM) and static random access memory (SRAM)), read-only memory (ROM), electrically erasable programmable read-only memory (EEPROM).

The battery 110 supplies power used for the aerosol generating apparatus 1 to operate. In other words, the battery 110 may supply power such that the heater 10 may be heated. The battery 110 may also supply power necessary for respective operations of the other hardware components included in the aerosol generating apparatus 1, for example, the controller 120, the sensor 130, and the interface 140. The battery 110 may be a lithium iron phosphate ($LiFePO_4$) battery, but embodiments are not limited thereto. The battery 110 may be manufactured as a lithium cobalt oxide ($LiCoO_2$) battery, a lithium titanate battery, or the like. The battery 110 may be a rechargeable battery or a disposable battery.

The sensor 130 may include various types of sensors such as a puff detection sensor (e.g., a temperature detection sensor or a flow detection sensor), and a cigarette detection sensor. The puff detection sensor may be implemented by using a pressure sensor or the like. The cigarette detection sensor may be implemented by using a capacitive sensor or a resistive sensor. The result of the sensing by the sensor 130 may be transferred to the controller 120. According to the result of the sensing, the controller 120 may control the aerosol generating apparatus 1 such that various functions such as heater temperature control, smoking restriction, and notification display may be performed.

The interface 140 may include various interfacing means such as a display or lamp for outputting visual information, a motor for outputting tactile information, a speaker for outputting sound information, input/output (I/O) interfacing means (for example, a button or a touch screen) for receiving information input by a user or outputting information to the user, terminals for communicating with a cradle (or referred to as a cradle device) through data or receiving charging power from the cradle, and a communication interfacing module for performing wireless communication (for example, WI-FI, WI-FI Direct, Bluetooth, or Near-Field Communication (NFC)) with an external device. However, the aerosol generating apparatus 1 may be implemented by selecting only some of the aforementioned various interfacing means.

Figure 3A:
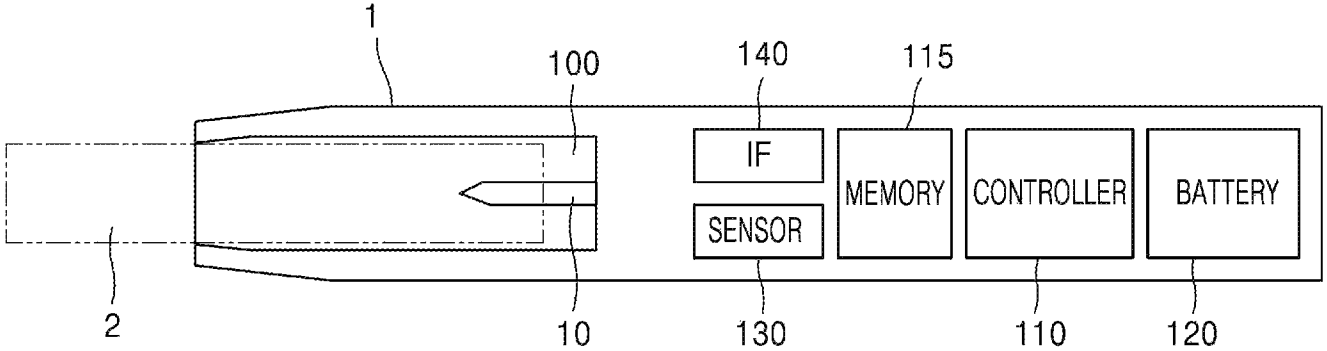
FIG. 3A illustrates an aerosol generating apparatus manufactured in the form of a holder according to an embodiment.

FIG. 3A illustrates an aerosol generating apparatus 1 manufactured in the form of a holder according to an embodiment.

Referring to FIG. 3A, the heater 10 of the aerosol generating apparatus 1 may be implemented in the form of a single needle. The heater 10 in a needle shape may be inserted into the cigarette 3 and then may heat an aerosol generating material of the cigarette 3 to thereby generate aerosol. However, embodiments are not limited thereto, and the heater 10 may be implemented in various other types capable of heating the inside or outside of the aerosol generating material.

In a housing of the aerosol generating apparatus 1, the heater 10, the controller 120, the memory 115, the battery 110, the sensor 130, and the interface 140 of FIG. 2 may be included. Functions and operations of the hardware components included in the aerosol generating apparatus 1 correspond to those described above with reference to FIG. 2.

Figure 3B:
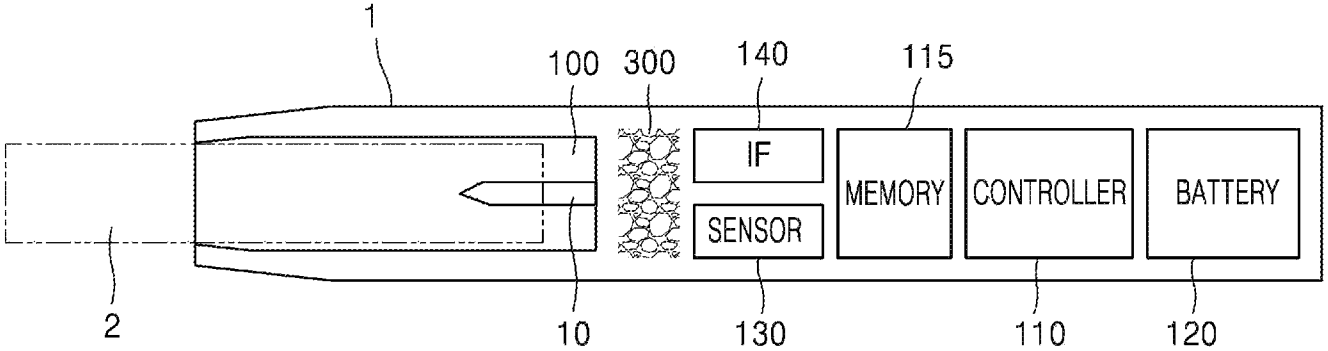
FIG. 3B illustrates an aerosol generating apparatus manufactured in the form of a holder according to another embodiment.

FIG. 3B illustrates an aerosol generating apparatus 1 manufactured in the form of a holder according to another embodiment.

Referring to FIG. 3B, compared with FIG. 3A, the aerosol generating apparatus 1 may further include a liquid storage 300. The liquid storage 300 includes a liquid aerosol generating material. The aerosol generating apparatus 1 of FIG. 3B may generate an aerosol generating material by simultaneously or alternately heating a solid aerosol generating material of the cigarette 3 and the liquid aerosol generating material of the liquid storage 300. The aerosol generating apparatus 1 of FIG. 3B may heat the liquid aerosol generating material by using a special heater, and the heater for heating the liquid aerosol generating material and the solid aerosol generating material may be implemented variously without restriction. Because the user inhales aerosol through a filter of the cigarette 3, a passage through which aerosol generated from the liquid aerosol generating material of the liquid storage 300 may flow into the filter of the cigarette 3 may be provided within the aerosol generating apparatus 1.

Embodiments of the disclosure will now be described in conjunction with the aerosol generating apparatus 1 having the hardware structure of FIG. 2, 3A, or 3B with reference to the following drawings.

Figure 4:
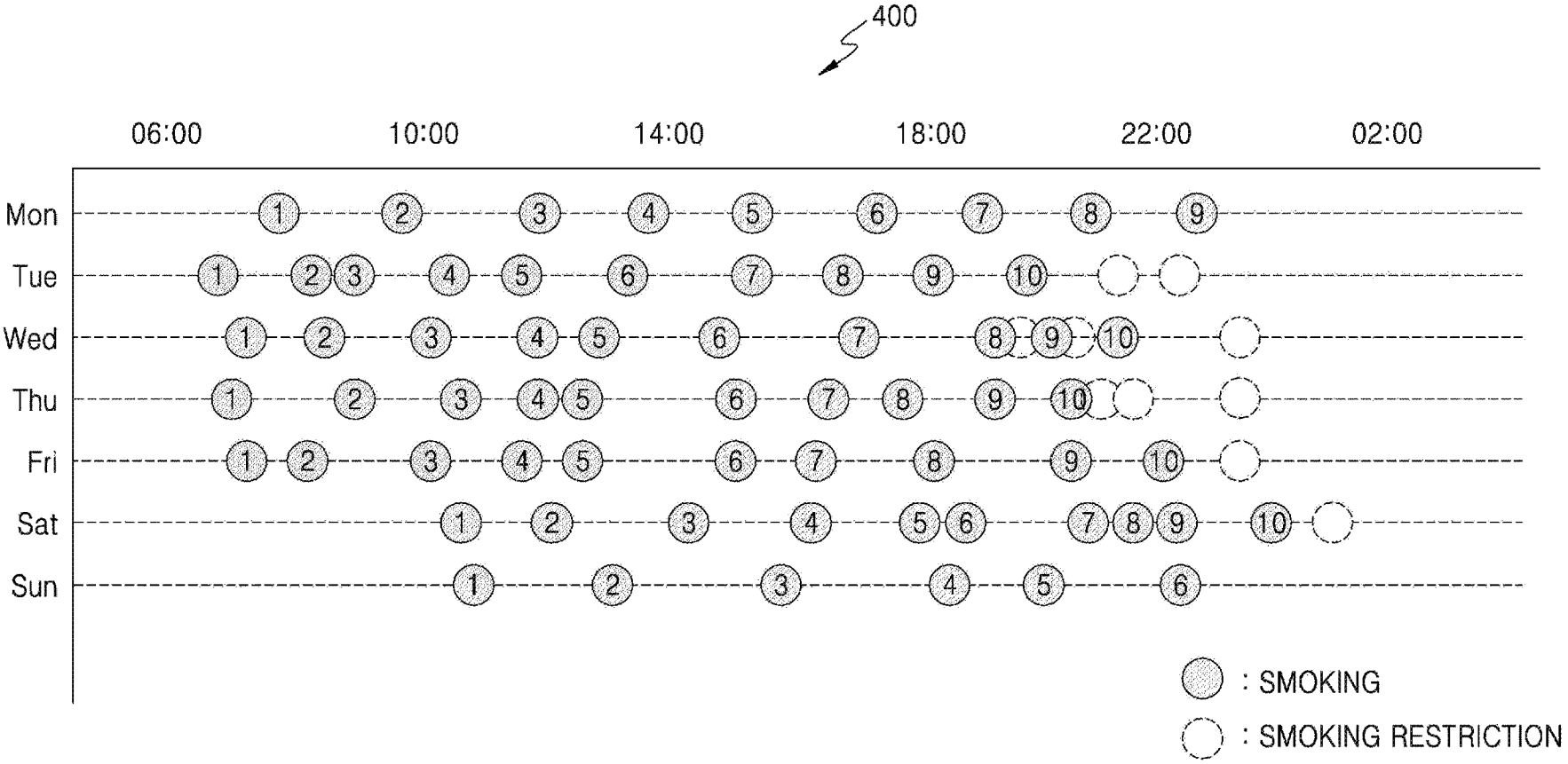
FIG. 4 illustrates a smoking pattern of a user who uses an aerosol generating apparatus according to an embodiment.

FIG. 4 illustrates a smoking pattern of a user who uses the aerosol generating apparatus 1 according to an embodiment.

Referring to FIG. 4, a table 400 shows a result of monitoring, for each day of the week, a smoking time and the number of times a user smokes while the user is using the aerosol generating apparatus 1 for one week. The table 400 is an arbitrary illustration for convenience of explanation of embodiments of the disclosure, and thus embodiments of the disclosure are not limited thereto.

The sensor 130 of the aerosol generating apparatus 1 may sense a start and an end of smoking by sensing insertion and extraction of the cigarette 3 or sensing a change in a heater temperature. Accordingly, the controller 120 may count the completion of one-time smoking, while determining a time when one-time smoking is completed, based on the result of the sensing. The controller 120 may check a smoking time and count the number of times a user smokes, based on a power on/off signal of the aerosol generating apparatus 1 due to an input of a button of the interface 140. The memory 115 may store cumulative information about the smoking time points and the numbers of times a user smokes. However, various other methods and criteria by which the aerosol generating apparatus 1 determines one time smoking may be employed.

In the illustration of FIG. 4, it is assumed that the user sets a smoking restriction function of the aerosol generating apparatus 1 so that smoking is performed only ten times during one day from AM 06:00 today to AM 06:00 next day by using the aerosol generating apparatus 1. However, the setting of smoking restriction conditions may vary. For example, in contrast with the above-described illustration, smoking is set to be performed only an arbitrary total number of times during an arbitrary time period, and a starting time point of reckoning the arbitrary time period may be set to be an arbitrary time point. To restrict smoking to a very short time interval, smoking within an arbitrary time period after previous smoking ends may also be set to be restricted.

Referring to the table 400, because the user smoked 9 times in total on Monday, the smoking restriction function of the aerosol generating apparatus 1 was not activated. The user smoked 10 times in total on Tuesday, and eleventh smoking and twelfth smoking after tenth smoking were not properly performed due to the smoking restriction function of the aerosol generating apparatus 1. The user smoked 10 times in total on Wednesday, and two smoking trials between eighth smoking and tenth smoking were restricted due to the smoking restriction function, and eleventh smoking was also restricted. As such, the controller 120 of the aerosol generating apparatus 1 may accumulate and count the number of times the user smokes. When set smoking restriction conditions are satisfied, smoking of the user may be restricted by activating the smoking restriction function of the aerosol generating apparatus 1.

According to the smoking pattern from Thursday to Saturday shown in the table 400, similar to the smoking pattern from Tuesday to Wednesday, when the set smoking restriction conditions are satisfied, smoking of the user was restricted by the smoking restriction function of the aerosol generating apparatus 1.

The controller 120 of the aerosol generating apparatus 1 may determine whether the set smoking restriction conditions are satisfied, based on whether the number of times the user smokes during a preset threshold time period has reached a preset threshold number of times.

Furthermore, the aerosol generating apparatus 1 may restrict smoking trials after a set smoking restriction number of times is exceeded, and may also restrict adjacent smoking trials within a set smoking restriction time interval. However, because various smoking restriction conditions to be applied to the aerosol generating apparatus 1 may be set as described above, smoking may be restricted under the various smoking restriction conditions.

Figure 5:
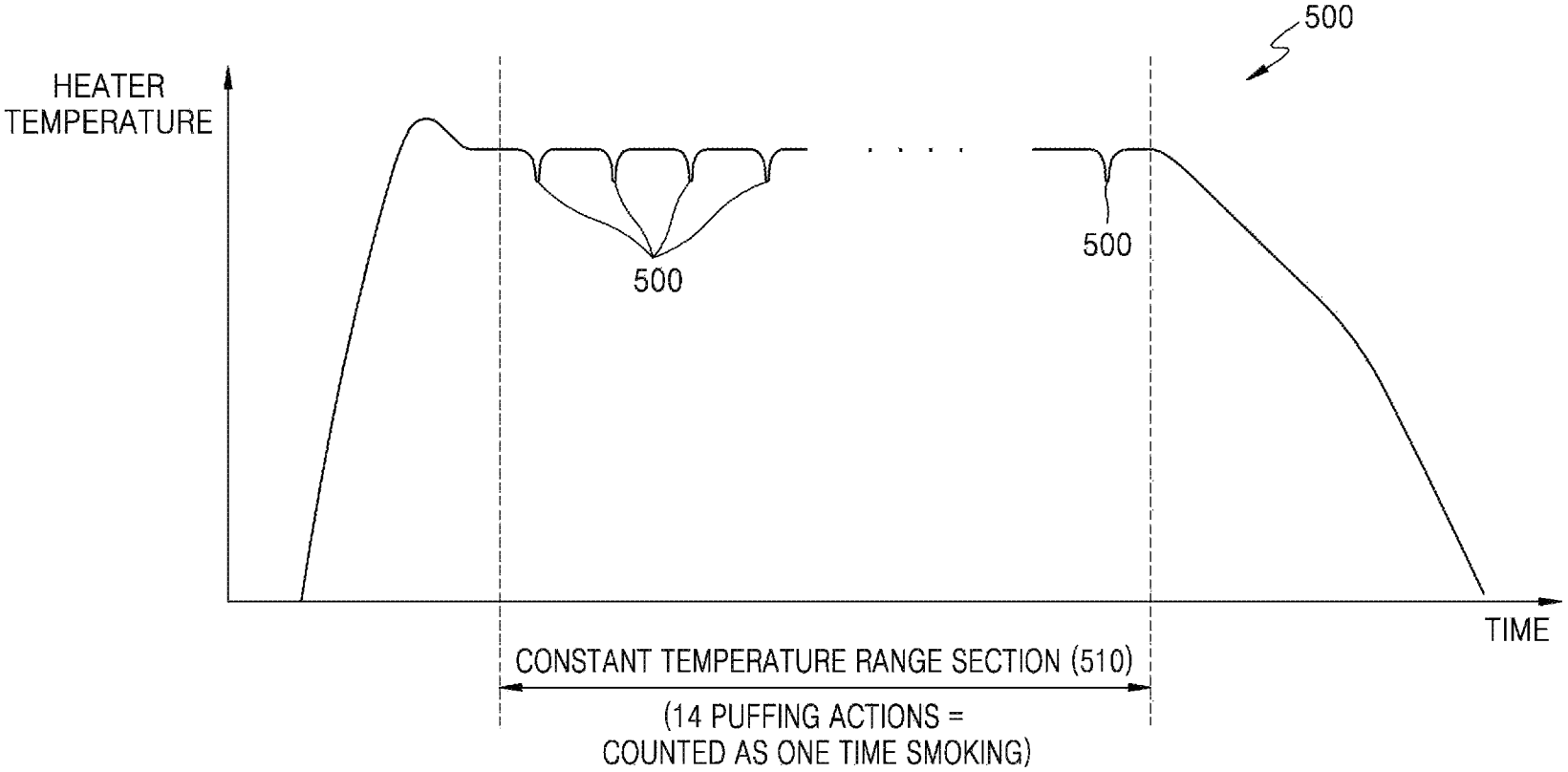
FIG. 5 is a graph for explaining determination of a start and an end of smoking according to a change in a heater temperature, according to an embodiment.

FIG. 5 is a graph for explaining determination of a start and an end of smoking according to a change in a heater temperature, according to an embodiment.

Referring to FIG. 5, the sensor 130 may be implemented to include a temperature detection sensor that senses a change in a heater temperature based on puffs of a user. Because air having a lower temperature than the heater temperature flows into the aerosol generating apparatus 1 when the user puffs, the temperature of the heater 10 may slightly decrease at a time point 500 when the user inhales aerosol. At this time, the aerosol generating apparatus 1 is supplying power to the heater 10 during smoking, and thus the heater temperature maintains a certain temperature again. Thus, the controller 120 of the aerosol generating apparatus 1 may determine that puffing occurs at the time point 500 when the heater temperature slightly decreases, while monitoring the heater temperatures sensed by the sensor 130 after smoking starts.

One time smoking may be counted as being completed when the user puffs the cigarette 3 a plurality of times. For example, one time smoking may be determined to be completed when the user puffs the cigarette 3 inserted into the aerosol generating apparatus 1 about 14 times. In other words, according to an embodiment, the controller 120 of the aerosol generating apparatus 1 may determine a start and an end of smoking, based on a puffing number of times corresponding to a change in the heater temperature, and may count the number of times the user smokes by determining that one time smoking has ended when the user puffs the cigarette 3 a preset threshold puffing number of times.

According to another embodiment, the aerosol generating apparatus 1 may count the number of times the user smokes, by determining a start and an end of smoking by using criteria other than the heater temperature.

For example, the sensor 130 of the aerosol generating apparatus 1 may be implemented to include a cigarette detection sensor. The controller 120 may determine that smoking has started, when the cigarette detection sensor senses that the cigarette 3 was inserted, and then may determine that smoking has ended, when the cigarette detection sensor senses that the cigarette 3 was extracted. In other words, the aerosol generating apparatus 1 may count one time smoking, based on a result of sensing the insertion and extraction of the cigarette 3.

The sensor 130 of the aerosol generating apparatus 1 may be implemented to include a flow detection sensor. Because external air flows into the aerosol generating apparatus 1 during user puffing and thus a flow rate within the aerosol generating apparatus 1 increases, the flow rate within the aerosol generating apparatus 1 may vary during every user puffing. Thus, the controller 120 of the aerosol generating apparatus 1 may determine a start and an end of smoking, based on a puffing number of times corresponding to a change in the flow rate, and may count the number of times the user smokes by determining that one time smoking has ended when the user puffs the cigarette 3 a preset threshold puffing number of times.

In addition, the aerosol generating apparatus 1 may count the number of times the user smokes, based on a button input via the interface 140.

Finally, the controller 120 of the aerosol generating apparatus 1 may count the number of times the user smokes, by determining a start and an end of smoking according to various methods such as a button input via the interface 140, sensing of cigarette insertion and extraction, sensing of puffing due to a change in the heater temperature, and sensing of puffing due to a change in the flow rate.

The aerosol generating apparatus 1 may restrict smoking of the user by activating the smoking restriction function when the smoking restriction conditions are satisfied, while monitoring a result of counting the number of times the user smokes according to any of the above-described methods and information about a smoking-completion time point as in the table 400 of FIG. 4.

Figure 6:
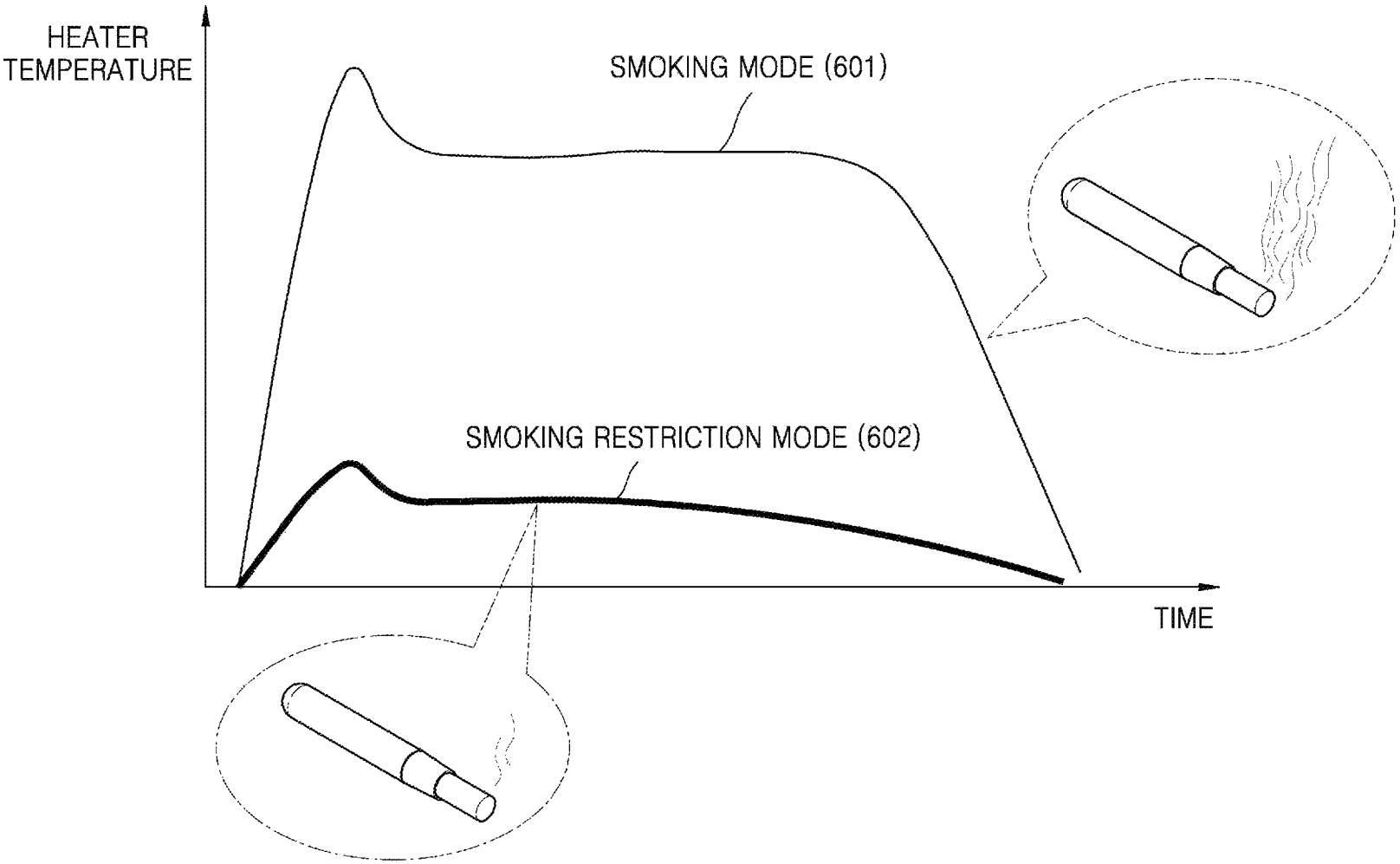
FIG. 6 is a diagram for explaining a smoking restriction function of an aerosol generating apparatus according to an embodiment.

FIG. 6 is a diagram for explaining a smoking restriction function of an aerosol generating apparatus, according to an embodiment.

FIG. 6 illustrates a heater temperature variation graph 601 in a smoking mode and a heater temperature variation graph 602 in a smoking restriction mode. In the smoking mode, the smoking restriction function of the aerosol generating apparatus 1 is inactivated, and thus a user is able to normally smoke the cigarette 3 inserted into the aerosol generating apparatus 1. In the smoking restriction mode, the smoking restriction function of the aerosol generating apparatus 1 is activated, and thus, even when the user turns on the aerosol generating apparatus 1 and inserts the cigarette 3 into the aerosol generating apparatus 1, normal smoking is restricted, in contrast with in the smoking mode. The smoking restriction mode may be activated when the number of times the user smokes satisfies a smoking restriction condition.

According to whether the smoking restriction condition is satisfied, the heater 10 may receive power for generating aerosol from the battery or supply of power to the heater 10 may be restricted, under the control of the controller 120. The aerosol generating apparatus 1 may execute various smoking restriction functions in the smoking restriction mode.

In an example of the smoking restriction function, as shown in the heater temperature variation graph 602, in the smoking restriction mode, the controller 120 may control the temperature of the heater 10 to be lower than a temperature range that is controlled in the smoking mode. In other words, in the smoking restriction mode where the smoking restriction condition is satisfied, the controller 120 may restrict power supply to the heater 10 to control the heater 10 in a low temperate range compared with the temperature range of the heater 10 that is controlled in the smoking mode where the smoking restriction condition is not satisfied. Accordingly, in the aerosol generating apparatus 1, only a relatively small amount of aerosol is generated. In other words, the low temperature range may mean a temperature range that enables the amount of aerosol generated by heating of the heater 10 in the smoking restriction mode to be less than the amount of aerosol generated by heating of the heater 10 in the smoking mode. Accordingly, the user merely inhale a small amount of aerosol even when the user puffs the cigarette 3, and thus the user may feel significantly reduced smoking compared with in the smoking mode. Consequently, smoking of the user may be restricted.

Meanwhile, the low temperature range in the smoking restriction mode may also mean a temperature range that is controlled within a section 510 maintained at a constant range of temperature to generate aerosol after preheating of the heater 10. However, embodiments are not limited thereto, and the low temperature range in the smoking restriction mode may mean a temperature range changing during the entire section ranging from the preheating of the heater 10 to cooling of the heater 10, or may mean a temperature range of any of various partial sections of the entire section. A temperature value controlled to be low may vary according to settings in the aerosol generating apparatus 1.

In another example of the smoking restriction function, in the smoking restriction mode, the controller 120 may deactivate the heater 10 so that, even when the cigarette 3 is inserted into the aerosol generating apparatus 1, the temperature of the heater 10 does not rise. Thus, no aerosol is generated in the aerosol generating apparatus 1, and accordingly the user may not feel smoking. Consequently, smoking of the user may be restricted.

Figure 7:
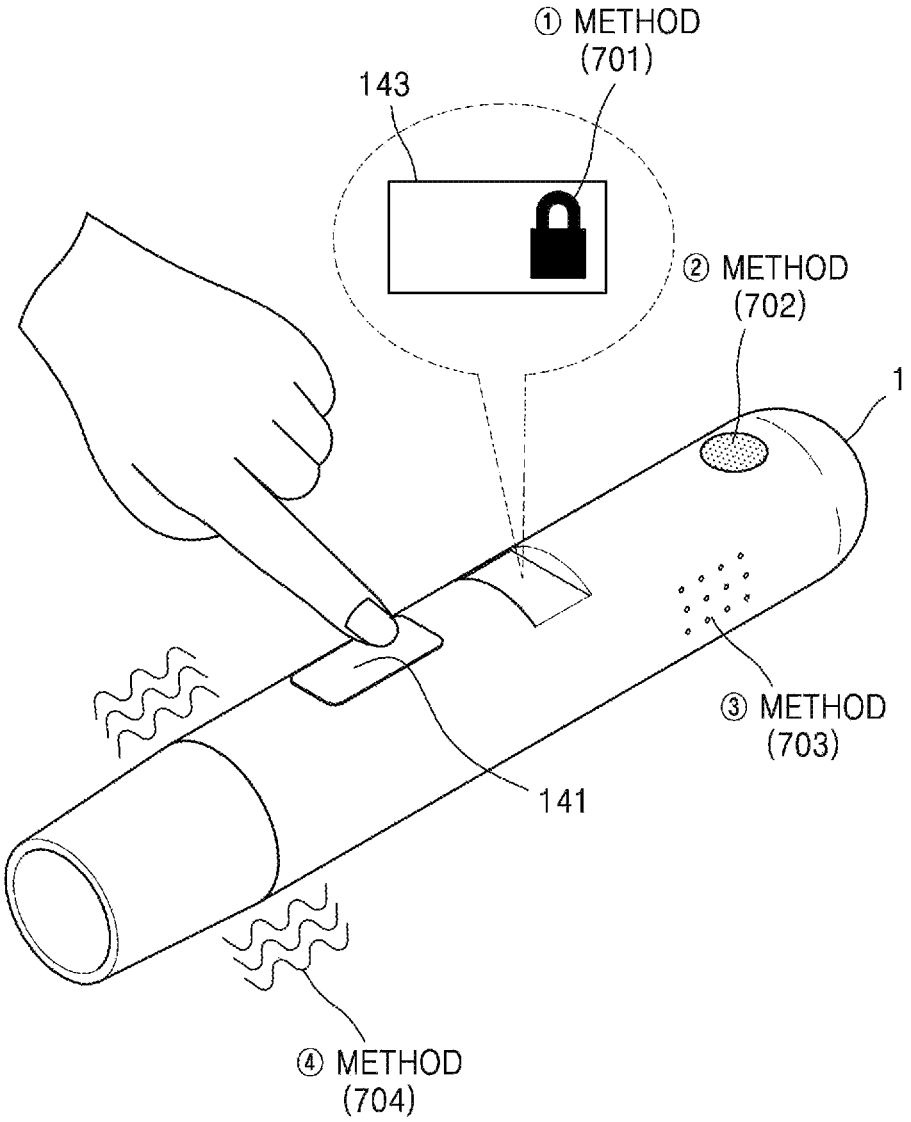
FIG. 7 is a diagram for explaining interfacing methods of an aerosol generating apparatus in the smoking restriction mode, according to an embodiment.

FIG. 7 is a diagram for explaining interfacing methods of an aerosol generating apparatus in the smoking restriction mode, according to an embodiment.

Referring to FIG. 7, a user may turn on the aerosol generating apparatus 1 and request the aerosol generating apparatus 1 to start smoking, by clicking a button 141 of the interface 140. At this time, the aerosol generating apparatus 1 may inform the user that the smoking restriction function is currently activated, according to various methods via the interface 140.

According to ① method 701, when the interface 140 of the aerosol generating apparatus 1 is implemented to include a display 143, the display 143 may display a symbol informing the user that the smoking restriction function of the aerosol generating apparatus 1 is currently activated according to the smoking restriction mode.

According to ② method 702, when the interface 140 of the aerosol generating apparatus 1 is implemented to include a lamp (for example, an LED lamp), the lamp may, for example, change its color or flicker in order to inform the user that the smoking restriction function of the aerosol generating apparatus 1 is currently activated according to the smoking restriction mode.

According to ③ method 703, when the interface 140 of the aerosol generating apparatus 1 is implemented to include a speaker, the speaker may output a sound to inform the user that the smoking restriction function of the aerosol generating apparatus 1 is currently activated according to the smoking restriction mode.

According to ④ method 704, when the interface 140 of the aerosol generating apparatus 1 is implemented to include a motor, the motor may generate a vibration to inform the user that the smoking restriction function of the aerosol generating apparatus 1 is currently activated according to the smoking restriction mode.

In the smoking restriction mode where the smoking restriction condition is satisfied, the interface 140 may provide a notification indicating that the smoking restriction mode has been activated, by using an interfacing means such as the display 143, the lamp, the speaker, or the motor vibration. The aerosol generating apparatus 1 may also provide the user with a notification of the smoking restriction mode by using any of various methods according to different types of hardware components included in the interface 140.

Figure 8:
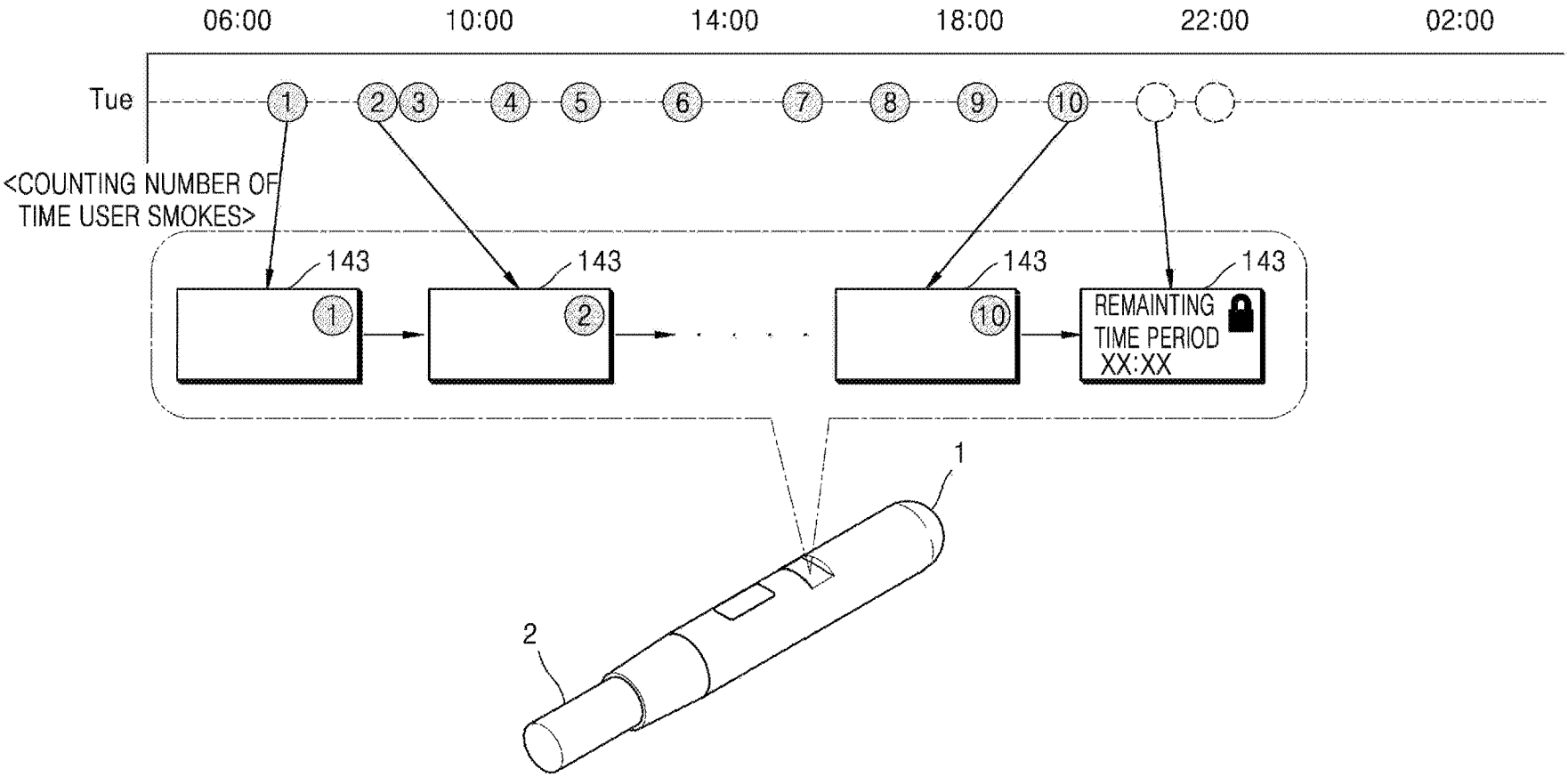
FIG. 8 is a diagram for explaining display of information about the number of times a user smokes and information about the smoking restriction mode via an interface, according to an embodiment.

FIG. 8 is a diagram for explaining display of information about the number of times a user smokes and information about the smoking restriction mode via an interface, according to an embodiment.

Referring to FIG. 8, when the aerosol generating apparatus 1 includes the display 143 and the user inserts the cigarette 3 into the aerosol generating apparatus 1 and completes smoking, the cumulative number of times the user smokes may be displayed via the display 143. When the smoking restriction condition is set as ten times per day, the display 143 may display a symbol indicating that the smoking restriction function is activated according to the smoking restriction mode, with respect to two times of smoking trials around 22:00.

Figure 9:
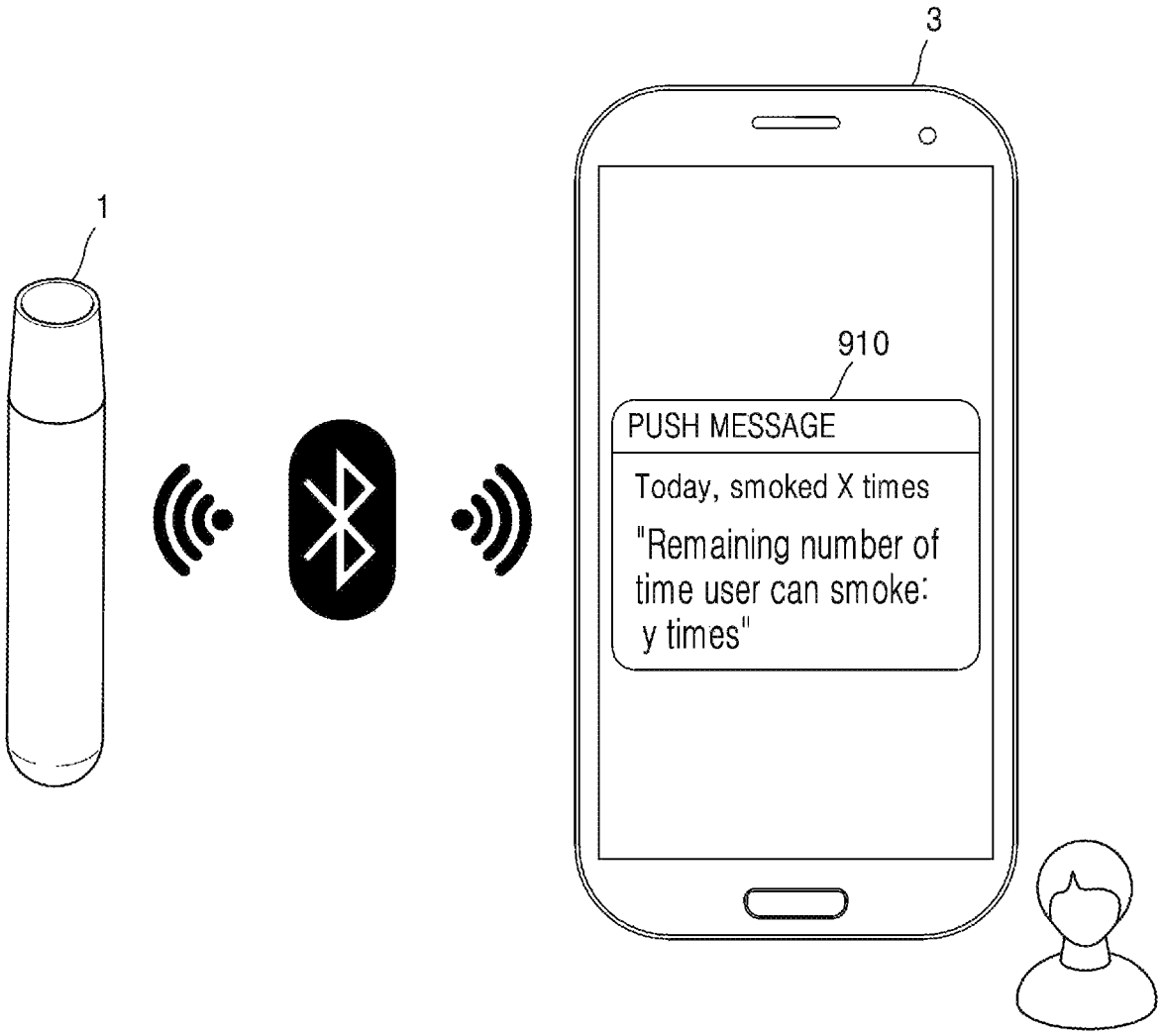
FIG. 9 is a diagram for explaining display of information about the number of times a user smokes and information about the smoking restriction mode via an interface, according to another embodiment.

FIG. 9 is a diagram for explaining display of information about the number of times a user smokes and information about the smoking restriction mode via an interface, according to another embodiment.

Referring to FIG. 9, the interface 140 of the aerosol generating apparatus 1 may be implemented to include a communication interface module for performing wireless communication (for example, Bluetooth) with an external device 900. The interface 140 may transmit the information about the number of times a user smokes, which is determined by the controller 120, and the information about the smoking restriction mode to the external device 900 via wireless communication. Accordingly, the external device 900 may provide a push message indicating received information, via a pop-up window 910. Accordingly, even when the aerosol generating apparatus 1 does not include the display 143, the user may check the information about the number of times a user smokes and the information about the smoking restriction mode via the pop-up window 910 displayed on the external device 900.

Figure 10:
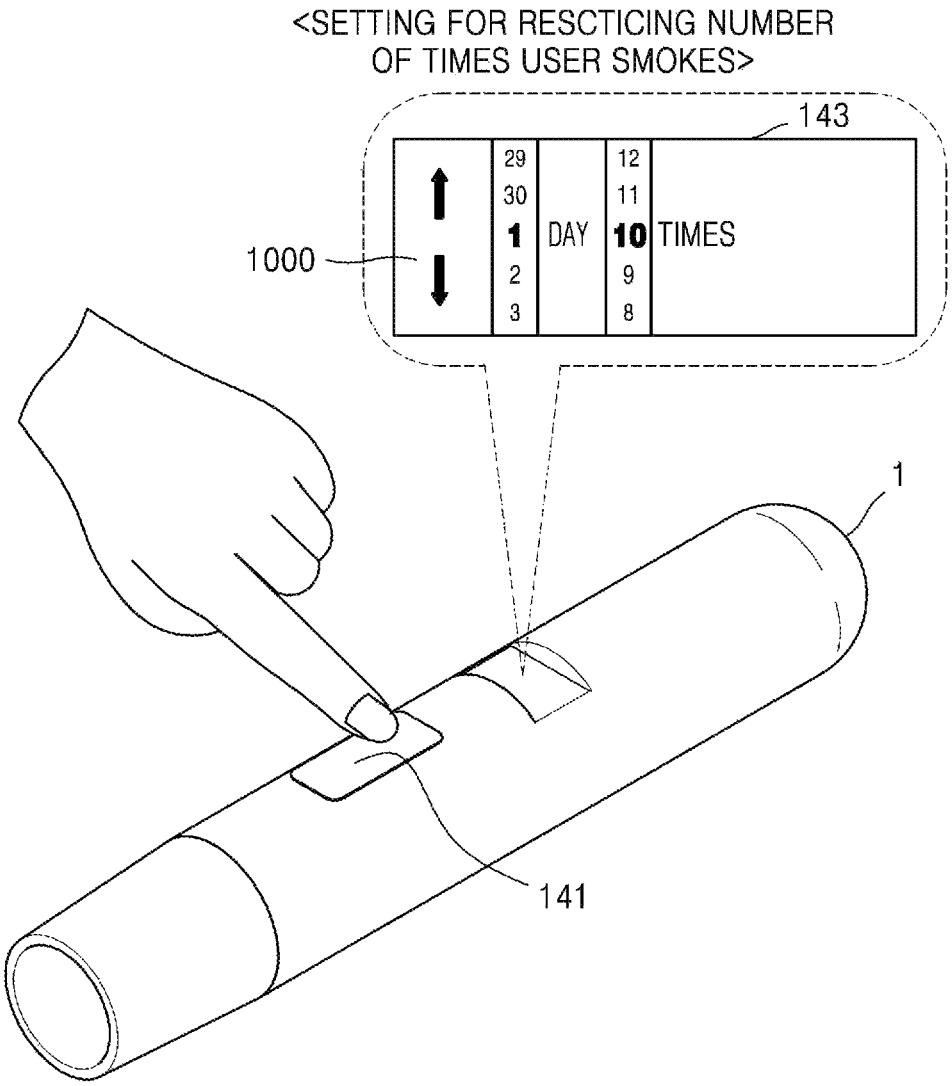
FIG. 10 is a diagram for explaining setting of a smoking restriction condition in an aerosol generating apparatus, according to an embodiment.

FIG. 10 is a diagram for explaining setting of a smoking restriction condition in an aerosol generating apparatus, according to an embodiment.

Referring to FIG. 10, the interface 140 of the aerosol generating apparatus 1 may be implemented to include the button 141 and the display 143. Alternatively, although not shown in FIG. 10, the interface 140 may be implemented to include a touch screen.

The items of the smoking restriction condition may include a threshold number, a threshold period, and the like. For example, the display 143 may display an image 1000 on which a threshold number, a threshold period, and the like may be set via scrolling, and the user may set smoking restriction condition items such as a desired threshold number, a desired threshold period, and the like by scrolling the image 1000 via an input of the button 141.

Figure 11:
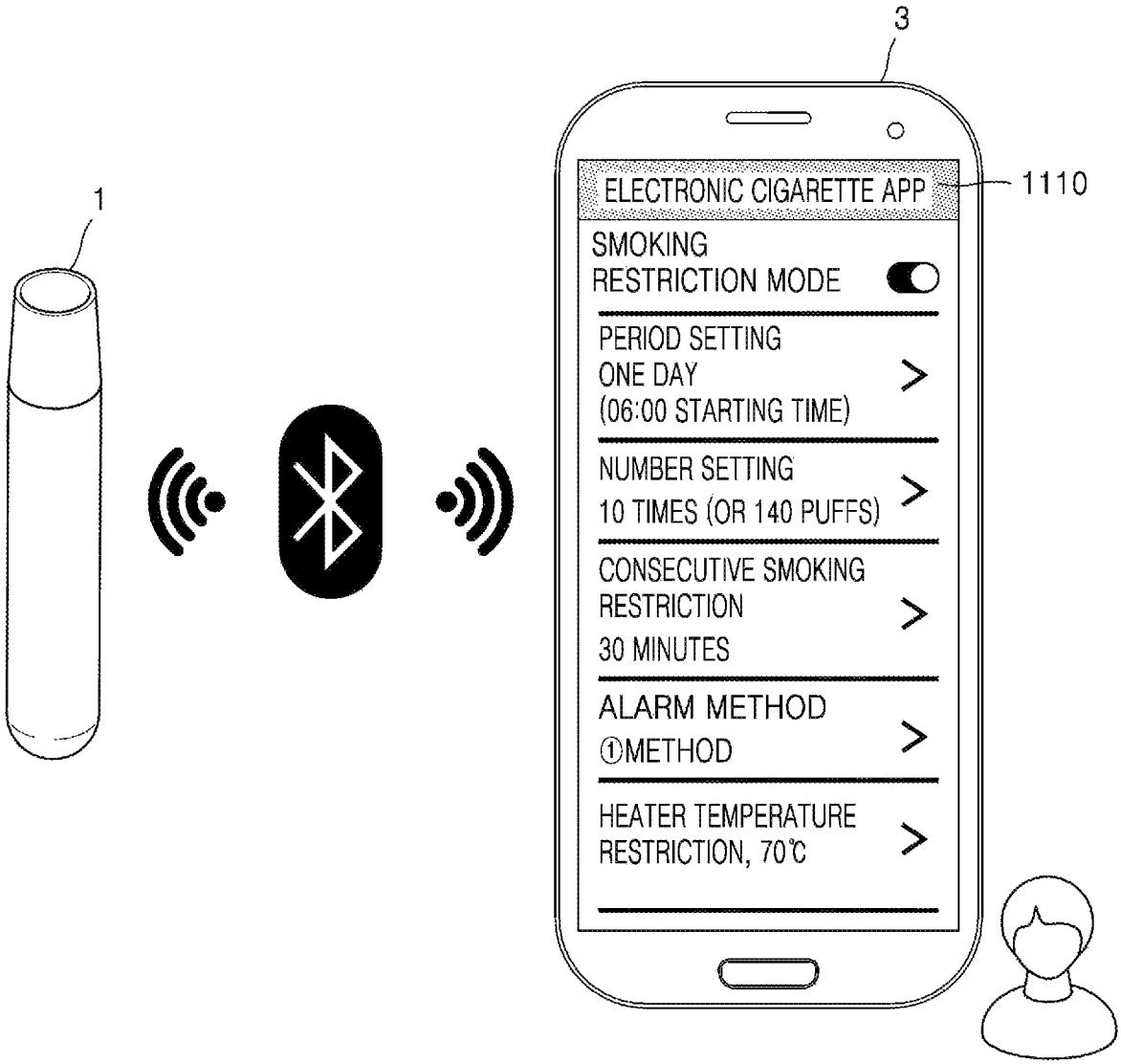
FIG. 11 is a diagram for explaining setting of a smoking restriction condition in an aerosol generating apparatus, according to another embodiment.

FIG. 11 is a diagram for explaining setting of smoking restriction conditions in an aerosol generating apparatus, according to another embodiment.

Referring to FIG. 11, the interface 140 of the aerosol generating apparatus 1 may be implemented to include a communication interface module for performing wireless communication (for example, Bluetooth) with the external device 900. When the aerosol generating apparatus 1 and the external device 900 are connected to each other, an electronic cigarette app 1110 may be executed in the external device 900. A user may set various items such as smoking restriction conditions, an alarm method, and a heater temperature, by using the electronic cigarette app 1100.

First, whether to use the smoking restriction mode in the aerosol generating apparatus 1 may be set via the electronic cigarette app 1100. If the smoking restriction mode is not used, the aerosol generating apparatus 1 is able to perform smoking regardless of the number of times the user smokes.

A threshold period may be set as one of the smoking restriction conditions. The threshold period means a period to restrict the number of times the user smokes. The threshold period may be set on the basis of one day, one week, and one month, or set for any of various other periods such as a specific day of the week and a specific time zone. Furthermore, the starting point of reckoning the threshold period may be set.

A threshold number may be set as another of the smoking restriction conditions. When smoking occurs a set threshold number of times within a set threshold period, subsequent smoking trials may be restricted. As for the threshold number, a total smoking number of times may be set or a total puffing number of times may be set. As described above, one time smoking may be counted as being completed when the user puffs the cigarette 3 a plurality of times (e.g., 14 times).

A consecutive smoking restriction period may be set as another of the smoking restriction conditions. Because the aerosol generating apparatus 1 electrically heats the heater 10, when consecutive smoking actions may be tried within a short period of time, lifespans of the heater 10 and the aerosol generating apparatus 1 may be reduced. In other words, after heating of the heater 10 for smoking, a desirable cooling time period may be needed. Consecutive smoking actions within a short period of time are harmful to the health of the user. Accordingly, smoking of the user may be restricted within the consecutive smoking restriction period set as another of the smoking restriction conditions. Referring back to FIG. 4, the user was restricted from smoking between eighth smoking and tenth smoking on Wednesday, because the consecutive smoking restriction period was set.

A method of informing activation of the smoking restriction mode may be set via the electronic cigarette app 1100. For example, at least one of the methods described above with reference to FIG. 7 may be set.

When the smoking restriction mode is activated, a heater temperature lowering method has been illustrated and described above as one of the methods of restricting smoking with reference to FIG. 6. A heater temperature range to be restricted in the smoking restriction mode may be set via the electronic cigarette app 1100.

Although various items that may be set via the electronic cigarette app 1110 has been described above with reference to FIG. 11, this is merely an example for convenience of explanation of embodiments of the disclosure, and the electronic cigarette app 1110 may provide only some of the items described above with reference to FIG. 11 or may further provide other general-use items.

When various settings are completed via the electronic cigarette app 1110 executed in the external device 900, the external device 900 may transmit setting information input by the electronic cigarette app 1110 to the aerosol generating apparatus 1 via wireless communication. Thereafter, the aerosol generating apparatus 1 may operate according to the received setting information.

Figure 12:
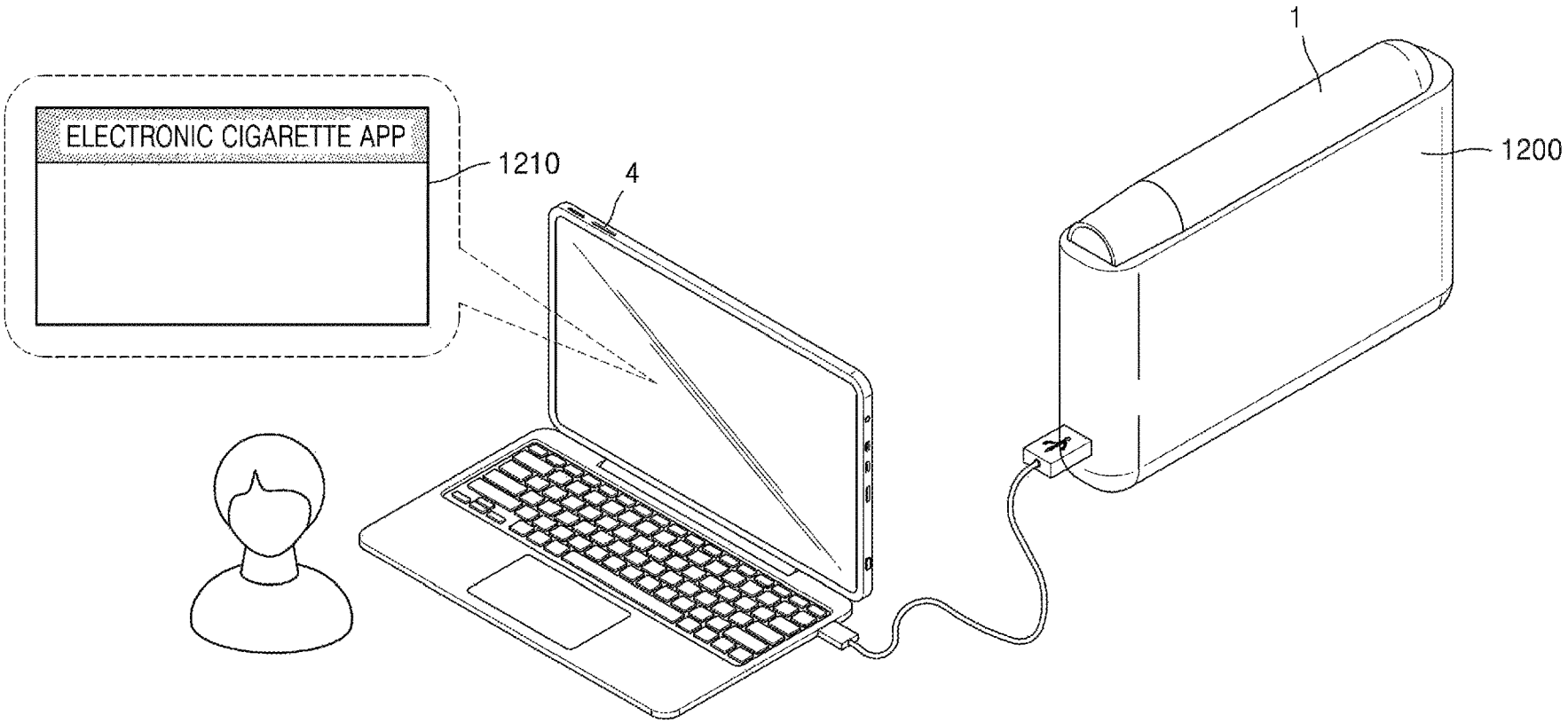
FIG. 12 is a diagram for explaining setting of smoking restriction conditions in an aerosol generating apparatus, according to another embodiment.

FIG. 12 is a diagram for explaining setting of smoking restriction conditions in an aerosol generating apparatus, according to another embodiment.

Referring to FIG. 12, the aerosol generating apparatus 1 may be combined with a cradle 2. The cradle 2 may be a device that provides charging power to the aerosol generating apparatus 1. The aerosol generating apparatus 1 and the cradle 2 contact each other via contact between their terminals. The terminals of the aerosol generating apparatus 1 are implemented by using, for example, micro-pins, and are included in the interface 140. Some terminals of the aerosol generating apparatus 1 may include terminals for communication and terminals for charging.

The cradle 2 may be wiredly connected to an external device 1200 via a cable. When the aerosol generating apparatus 1 is coupled with the cradle 2 and is connected to an external device 1200 by wire, a user may execute an electronic cigarette app 1210 in the external device 1200 and input settings regarding the aerosol generating apparatus 1. The settings regarding the aerosol generating apparatus 1 may include the various settings described above with reference to FIG. 11.

When various settings have been completed via the electronic cigarette app 1210 executed in the external device 1200, the external device 1200 may transmit setting information input by the electronic cigarette app 1210 to the cradle 2 via wired communication. The cradle 2 may transmit the setting information to the aerosol generating apparatus 1 via a communication terminal in contact with the aerosol generating apparatus 1, and the aerosol generating apparatus 1 may operate according to the received setting information.

Finally, the smoking restriction conditions may be based on setting information input via the interface 140, setting information received from the external device 900 via wireless communication, and setting information received from the external device 1200 via wired communication when the external device 1200 is coupled with the cradle 2.

Although not shown in FIG. 12, the cradle 2 is able to perform wireless communication (for example, WI-FI, WI-FI Direct, Bluetooth, or NFC) with the external device 1200, instead of wired communication. In other words, when the aerosol generating apparatus 1 is inserted into the cradle 2, the external device 1200 is able to perform wireless communication with the cradle 2, the external device 1200 is able to set setting information via the electronic cigarette app 1210, and the external device 1200 is able to transmit setting information to the cradle 2. The setting information wirelessly received by the cradle 2 is finally applicable as settings of the aerosol generating apparatus 1.

Figure 13:
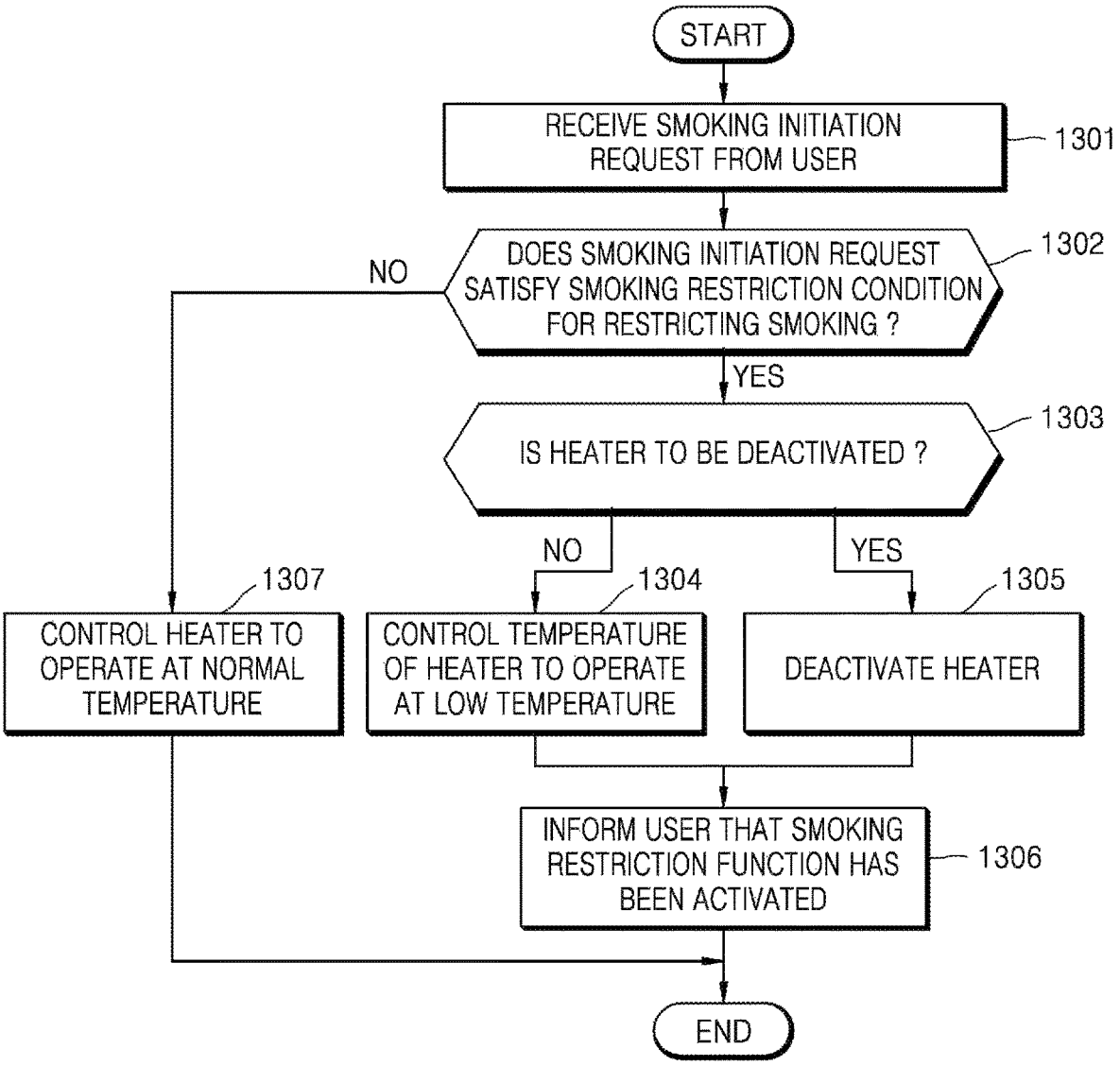
FIG. 13 is a flowchart of a method of providing a smoking restriction function in an aerosol generating apparatus according to an embodiment.

FIG. 13 is a flowchart of a method of providing a smoking restriction function in an aerosol generating apparatus according to an embodiment.

Referring to FIG. 13, the method of providing a smoking restriction function includes operations sequentially performed in the aerosol generating apparatus 1 described above with reference to the aforementioned drawings. Accordingly, although omitted hereinafter, descriptions given above with regard to the aerosol generating apparatus 1 with reference to the aforementioned drawings are applicable to the method of FIG. 13.

In operation 1301, the aerosol generating apparatus 1 receives a smoking initiation request from a user. A determination as to whether the smoking initiation request exists may be based on a determination by the controller 120 as to whether there is an input via the interface 140 of the aerosol generating apparatus 1 or results of detection of cigarette insertion by the sensor 130 and sensing of a change in a heater temperature.

In operation 1302, the controller 120 determines whether the smoking initiation request satisfies a smoking restriction condition for restricting smoking, based on data about a smoking pattern stored in the memory 115. In detail, the controller 120 determines whether a smoking number counted up to a current time has reached a threshold number. When it is determined that the smoking number counted up to a current time has reached the threshold number, the controller 120 activate the smoking restriction mode and performs operation 1303. On the other hand, when it is determined that the smoking number counted up to a current time has not reached the threshold number, the controller 120 performs operation 1307 according to the smoking mode.

In operation 1303, the controller 120 determines whether to deactivate the heater 10 in the smoking restriction mode.

In operation 1304, the controller 120 controls the temperature of the heater 10 to be lower than a temperature range of the heater 10 that is controlled in the smoking mode, thereby restricting smoking of the user.

In operation 1305, the controller 120 deactivates the heater 10 to thereby restricting smoking of the user.

In operation 1306, the interface 140 informs the user that the smoking restriction function has been activated, via a display, a lamp, a speaker, vibration of a motor, or the like.

In operation 1307, the controller 120 controls the heater 10 to a temperature where aerosol may be normally generated, according to the smoking mode.

Figure 14:
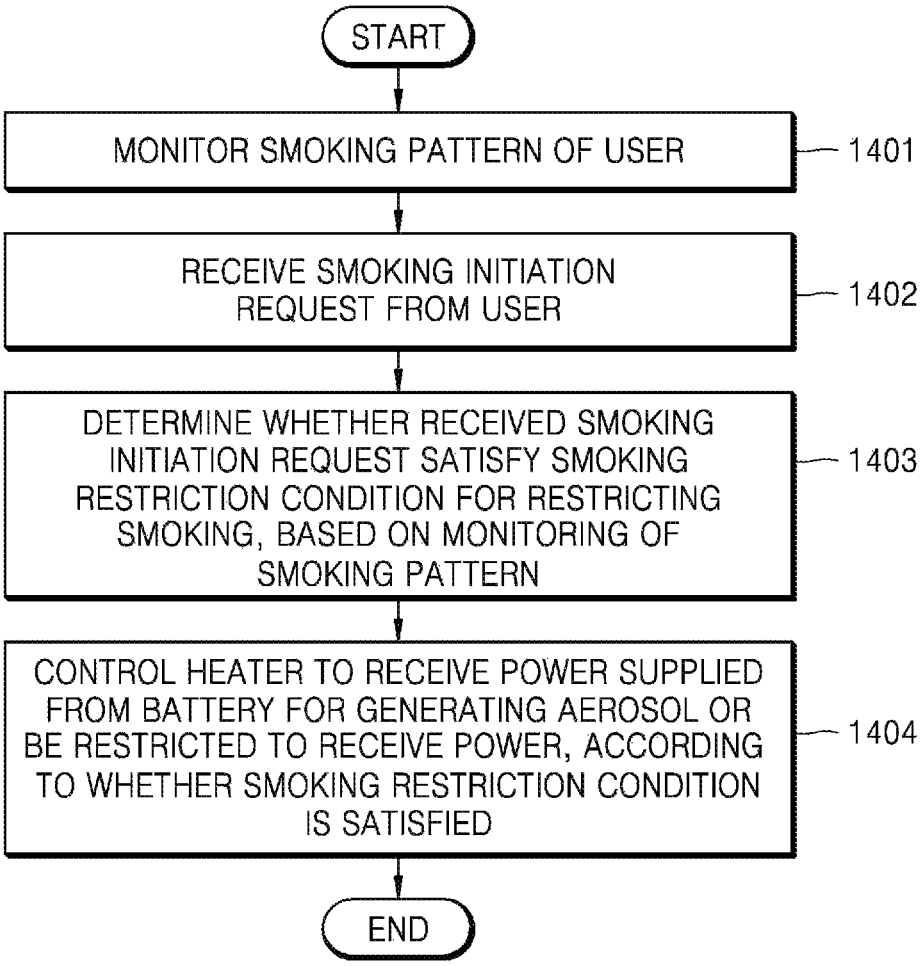
FIG. 14 is a flowchart of a method of providing a smoking restriction function in an aerosol generating apparatus according to an embodiment.

FIG. 14 is a flowchart of a method of providing a smoking restriction function in an aerosol generating apparatus according to an embodiment.

Referring to FIG. 14, the method of providing a smoking restriction function includes operations sequentially performed in the aerosol generating apparatus 1 described above with reference to the aforementioned drawings. Accordingly, although omitted hereinafter, descriptions given above with regard to the aerosol generating apparatus 1 with reference to the aforementioned drawings are applicable to the method of FIG. 14.

In operation 1401, the controller 120 monitors a smoking pattern of a user. A result of the monitoring is stored in the memory 115.

In operation 1402, the interface 140 receives a smoking initiation request from the user.

In operation 1403, the controller 120 determines whether the received smoking initiation request satisfies a smoking restriction condition for restricting smoking, based on the monitoring of the smoking pattern.

Figure 15:
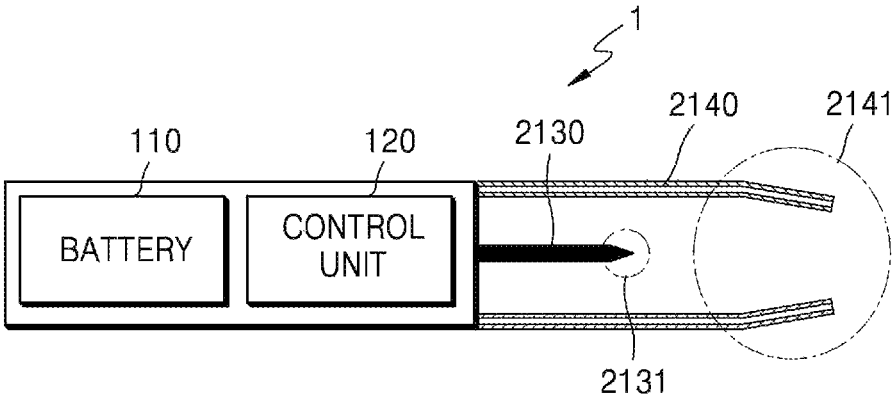
FIG. 15 is a block diagram showing an example of an aerosol generating apparatus.

In operation 1404, the controller 120 controls the heater 10 such that power for generating aerosol is supplied from the battery to the heater 10 or power supply is restricted, according to whether the smoking restriction condition is satisfied. FIG. 15 is a block diagram showing an example of an aerosol generating apparatus.

Referring to FIG. 15, an aerosol generating apparatus 1 (hereinafter, referred to as a 'holder') includes a battery 110, a control unit 120, and a heater 2130. The holder 1 also includes an inner space formed by a casing 2140. A cigarette may be inserted into the inner space of the holder 1.

Only components related with the present embodiment from among the components of the holder 1 are shown in FIG. 15. Accordingly, it will be understood by one of ordinary skill in the art related with the present embodiment that general-use components other than the components illustrated in FIG. 15 may be further included in the holder 1.

When a cigarette is inserted into the holder 1, the holder 1 heats the heater 2130. The temperature of an aerosol generating material in the cigarette is raised by the heated heater 2130, and thus aerosol is generated. The generated aerosol is delivered to a user through a cigarette filter. However, even when a cigarette is not inserted into the holder 1, the holder 1 may heat the heater 2130.

The casing 2140 may be detached from the holder 1. For example, when a user rotates the casing 2140 clockwise or counterclockwise, the casing 2140 may be detached from the holder 1.

The diameter of a hole formed by a terminal end 2141 of the casing 2140 may be smaller than the diameter of a space formed by the casing 2140 and the heater 2130. In this case, the hole may serve as a guide for a cigarette inserted into the holder 1.

The battery 110 supplies power used for the holder 1 to operate. For example, the battery 110 may supply power for heating the heater 2130 and supply power for operating the control unit 120. In addition, the battery 110 may supply power for operating a display, a sensor, a motor, and the like installed in the holder 1.

The battery 110 may be a lithium iron phosphate (LiFePO4) battery, but is not limited to the example described above. For example, the battery 110 may be a lithium cobalt oxide (LiCoO2) battery, a lithium titanate battery, etc.

Also, the battery 110 may have a cylindrical shape having a diameter of 10 mm and a length of 37 mm, but is not limited thereto. The capacity of the battery 110 may be 120 mAh or more, and the battery 110 may be a rechargeable battery or a disposable battery. For example, when the battery 110 is rechargeable, the charging rate (C-rate) of the battery 110 may be 10C and the discharging rate (C-rate) may be 16C to 20C. However, the present disclosure is not limited thereto. Also, for stable use, the battery 110 may be manufactured, such that 80% or more of the total capacity may be ensured even when charging/discharging are performed 8000 times.

Here, it may be determined whether the battery 110 is fully charged or completely discharged based on a level of power stored in the battery 110 as compared to the entire capacity of the battery 110. For example, when the power stored in the battery 110 is equal to or more than 95% of the total capacity, it may be determined that the battery 110 is fully charged. Furthermore, when the power stored in the battery 110 is 10% or less of the total capacity, it may be determined that the battery 110 is completely discharged. However, the criteria for determining whether the battery 110 is fully charged or completely discharged are not limited to the above examples.

The heater 2130 is heated by power supplied from the battery 110. When a cigarette is inserted into the holder 1, the heater 2130 is located inside the cigarette. Therefore, the heated heater 2130 may raise the temperature of the aerosol generating material in the cigarette.

The shape of the heater 2130 may be a combination of a cylindrical shape and a conical shape. For example, the heater 2130 may have a cylindrical shape having a diameter of about 2 mm and a length of about 23 mm, and a terminal end 2131 of the heater 2130 may be formed to have an acute angle, but is not limited thereto. In other words, the heater 2130 may have any shape as long as the heater 2130 may be inserted into the cigarette. In addition, only a portion of the heater 2130 may be heated. For example, assuming that the length of the heater 2130 is 23 mm, only 12 mm from the terminal end 2131 of the heater 2130 may be heated, and the remaining portion of the heater 2130 may not be heated.

The heater 2130 may be an electro-resistive heater. For example, the heater 2130 includes an electrically conductive track, and the heater 2130 may be heated as a current flows through the electrically conductive track.

For stable use, the heater 2130 may be supplied with power according to specifications of 3.2 V, 2.4 A, and 8 W, but is not limited thereto. For example, when power is supplied to the heater 2130, the surface temperature of the heater 2130 may rise to 400° C. or higher. The surface temperature of the heater 2130 may rise to about 350° C. before 15 seconds after the power supply to the heater 2130 starts.

The holder 1 may be provided with a separate temperature sensor. Alternatively, the holder 1 may not be provided with a temperature sensor, and the heater 2130 may serve as a temperature sensor. For example, the heater 2130 may further include a second electrically conductive track for temperature sensing in addition to a first electrically conductive track for generating heat.

For example, when a voltage applied to the second electrically conductive track and a current flowing through the second electrically conductive track are measured, a resistance R may be determined. At this time, a temperature T of the second electrically conductive track may be determined by Equation 1 below.

$$R=R_0\{1+\alpha(T-T_0)\} \quad \text{[Equation 1]}$$

In Equation 1, R denotes a current resistance value of the second electrically conductive track, $R_0$ denotes a resistance value at a temperature T0 (e.g., 0° C.), and a denotes a resistance temperature coefficient of the second electrically conductive track. Because conductive materials (e.g., metals) have inherent resistance temperature coefficients, a may be determined in advance according to a conductive material constituting the second electrically conductive track. Therefore, when the resistance R of the second electrically conductive track is determined, the temperature T of the second electrically conductive track may be calculated according to Equation 1.

The heater 2130 may include at least one electrically conductive track (a first electrically conductive track and a second electrically conductive track). For example, the heater 2130 may include, but is not limited to, two first electrically conductive tracks and one or two second electrically conductive tracks.

An electrically conductive track includes an electro-resistive material. For example, an electrically conductive track may include a metal. In another example, an electrically conductive track may include an electrically conductive ceramic material, carbon, a metal alloy, or a composite of a ceramic material and a metal.

In addition, the holder 1 may include both an electrically conductive track, which serves as temperature sensors, and a temperature sensor.

The control unit 120 controls the overall operation of the holder 1. In detail, the control unit 120 controls not only operations of the battery 110 and the heater 2130, but also operations of other components included in the holder 1. The control unit 120 may also check the status of each of the components of the holder 1 and determine whether the holder 1 is in an operable state.

The control unit 120 includes at least one processor. A processor may be implemented by an array of a plurality of logic gates, or by a combination of a general-use microprocessor and a memory in which a program executable by the general-use microprocessor is stored. It will also be understood by one of ordinary skill in the art to which this embodiment pertains that the central processor may be implemented by other types of hardware.

For example, the control unit 120 may control the operation of the heater 2130. The control unit 120 may control an amount of power supplied to the heater 2130 and a time period for supplying the power, such that the heater 2130 may be heated to a predetermined temperature or maintained at a proper temperature. The control unit 120 may also check the status of the battery 110 (e.g., the remaining amount of the battery 110) and generate a notification signal as occasions demand.

Also, the control unit 120 may check the presence or absence of a user's puff, check the strength of the puff, and count the number of puffs. Also, the control unit 120 may continuously check the time period during which the holder 1 is operating. The control unit 120 may also check whether a cradle 2 to be described below is coupled with the holder 1, and control the operation of the holder 1 according to whether the cradle 2 is coupled with or separated from the holder 1.

Meanwhile, the holder 1 may further include general-purpose components other than the battery 110, the control unit 120, and the heater 2130.

For example, the holder 1 may include a display capable of outputting visual information or a motor for outputting tactile information. For example, when a display is included in the holder 1, the control unit 120 may provide the user with information about the state of the holder 1 (e.g., availability on unavailability of the holder, etc.), information about the heater 2130 (e.g., start of preheating, progress of preheating, completion of preheating, etc.), information about the battery 110 (e.g., remaining power of the battery 110, availability on unavailability, etc.), information about resetting of the holder 1 (e.g., reset timing, reset progress, reset completion, etc.), information about cleaning of the holder 1 (e.g., cleaning timing, necessity of cleaning, cleaning progress, cleaning completion, etc.), information about charging of the holder 1 (e.g., necessity of charging, charging progress, charging completed, etc.), information about puffs (e.g., the number of puffs, notification of expected completion of puffs, etc.), or information about safety (e.g., the lapse of time of use, etc.) via the display. In another example, when a motor is included in the holder 1, the control unit 120 may transmit the above-described information to the user by generating a vibration signal by using the motor.

The holder 1 may also include a terminal coupled with at least one input device (e.g., a button) and/or the cradle 2 through which a user may control the function of the holder 1. For example, a user may perform various functions by using the input device of the holder 1. By adjusting the number of times a user presses the input device (e.g., once, twice, etc.) or the time during which the input device is being pressed (e.g., 0.1 second, 0.2 second, etc.), a desired function from among a plurality of functions of the holder 1 may be executed. As a user manipulates the input device, the holder 1 may perform a function of preheating the heater 2130, a function of regulating the temperature of the heater 2130, a function of cleaning the space in which a cigarette is inserted, a function of checking whether the holder 1 is in an operable state, a function of displaying the remaining power (available power) of the battery 110, a function of resetting the holder 1, etc. However, the functions of the holder 1 are not limited to the examples described above.

The holder 1 may also include a puff detecting sensor, a temperature detecting sensor, and/or a cigarette insertion detecting sensor. For example, the puff detecting sensor may be implemented by a common pressure sensor, and the cigarette insertion detecting sensor may be implemented by a common capacitive sensor or a resistance sensor. Also, the holder 1 may be fabricated to have a structure in which the outside air may flow in/out even in the state where the cigarette is inserted.

Figure 16A:
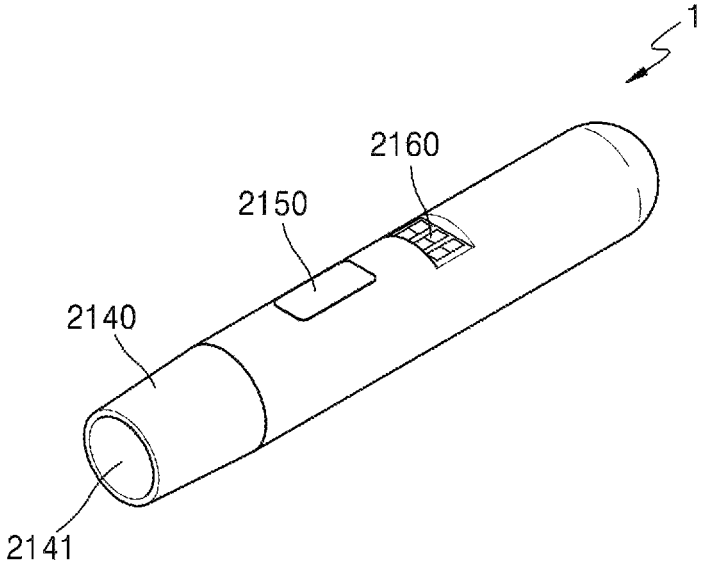
FIGS. 16A and 16B are diagrams showing various views of an example of a holder.
Figure 16B:
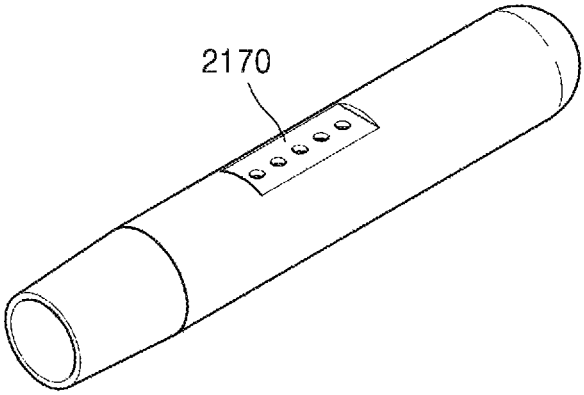

FIGS. 16A and 16B are diagrams showing various views of an example of a holder.

FIG. 16A is a diagram showing an example of the holder 1 viewed in a first direction. As shown in FIG. 16A, the holder 1 may be fabricated to have a cylindrical shape, but the present disclosure is not limited thereto. The casing 2140 of the holder 1 may be separated by an action of a user and a cigarette may be inserted into the terminal end 2141 of the casing 2140. The holder 1 may also include a button 2150 for a user to control the holder 1 and a display 2160 for outputting an image.

FIG. 16B is a diagram showing an example of the holder 1 viewed in a second direction. The holder 1 may include a terminal 2170 coupled with the cradle 2. As the terminal 2170 of the holder 1 is coupled with a terminal 2260 of the cradle 2, the battery 110 of the holder 1 may be charged by power supplied by a battery 210 of the cradle 2. Also, the holder 1 may be operated by power supplied from the battery 210 of the cradle 2 through the terminal 2170 and the terminal 2260 and a communication (transmission/reception of signals) may be performed between the holder 1 and the cradle 2 through the terminal 2170 and the terminal 2260. For example, the terminal 2170 may include four micro pins, but the present disclosure is not limited thereto.

Figure 17:
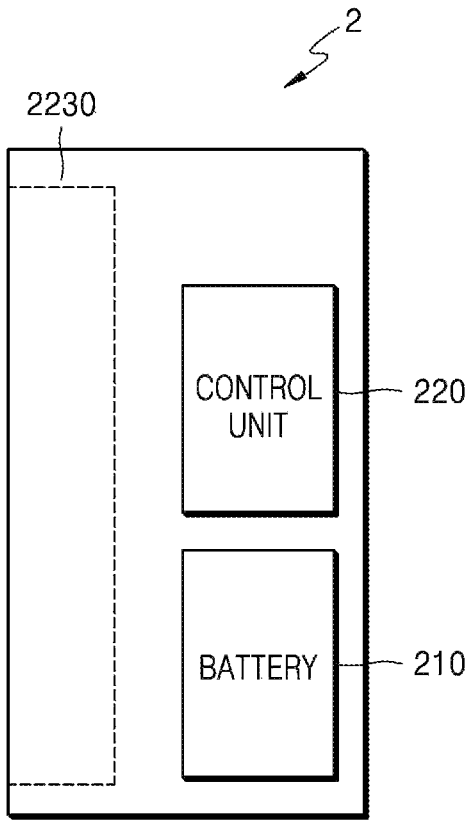
FIG. 17 is a diagram showing an example configuration of a cradle.

FIG. 17 is a diagram showing an example configuration of a cradle.

Referring to FIG. 17, the cradle 2 includes the battery 210 and a control unit 220. The cradle 2 also includes an inner space 2230 into which the holder 1 may be inserted. For example, the inner space 2230 may be formed on one side of the cradle 2. Therefore, the holder 1 may be inserted and fixed in the cradle 2 even when the cradle 2 does not include a separate lid.

Only components related with the present embodiment from among the components of the cradle 2 are shown in FIG. 17. Accordingly, it will be understood by one of ordinary skill in the art related with the present embodiment that general-use components other than the components illustrated in FIG. 17 may be further included in the cradle 2.

The battery 210 provides power used to operate the cradle 2. In addition, the battery 210 may supply power for charging the battery 110 of the holder 1. For example, when the holder 1 is inserted into the cradle 2 and the terminal 2170 of the holder 1 is coupled with the terminal 2260 of the cradle 2, the battery 210 of the cradle 2 may supply power to the battery 110 of the holder 1.

Also, when the holder 1 is coupled with the cradle 2, the battery 210 may supply power used for the holder 1 to operate. For example, when the terminal 2170 of the holder 1 is coupled with the terminal 2260 of the cradle 2, the holder 1 may operate by using power supplied by the battery 210 of the cradle 2 regardless of whether the battery 110 of the holder 1 is discharged or not.

An example of the type of the battery 210 may be the same as that of the type of the battery 110 described above with reference to FIG. 15. The capacity of the battery 210 may be greater than the capacity of the battery 110. For example, the capacity of the battery 210 may be, but is not limited to, 3000 mAh or greater.

The control unit 220 controls the overall operation of the cradle 2. The control unit 220 may control the operations of all the configurations of the cradle 2. The control unit 220 may also determine whether the holder 1 is coupled with the cradle 2 and control the operation of the cradle 2 according to coupling or separation of the cradle 2 and the holder 1.

For example, when the holder 1 is coupled with the cradle 2, the control unit 220 may supply power of the battery 210 to the holder 1, thereby charging the battery 110 or heating the heater 2130. Therefore, even when remaining power of the battery 110 is low, a user may continuously smoke by coupling the holder 1 with the cradle 2.

The control unit 220 includes at least one processor. A processor may be implemented by an array of a plurality of logic gates, or by a combination of a general-use microprocessor and a memory in which a program executable by the general-use microprocessor is stored. It will also be understood by one of ordinary skill in the art to which this example pertains that the central processor may be implemented by other types of hardware.

Meanwhile, the cradle 2 may further include general-purpose components other than the battery 210 and the control unit 220. For example, the cradle 2 may include a display capable of outputting visual information. For example, when the cradle 2 includes a display, the control unit 220 generates a signal to be displayed on the display, thereby informing a user of information regarding the battery 210 (e.g., the remaining power of the battery 210, availability or unavailability of the battery 210, etc.), information regarding resetting of the cradle 2 (e.g., reset timing, reset progress, reset completion, etc.), information regarding cleaning of the holder 1 (e.g., cleaning timing, cleaning necessity, cleaning progress, cleaning completion, etc.), and information regarding charging of the cradle 2 (e.g., charging necessity, charging progress, charging completion, etc.).

The cradle 2 may also include at least one input device (e.g., a button) for a user to control the function of the cradle 2, a terminal 260 to be coupled with the holder 1, and/or an interface for charging the battery 210 (e.g., an USB port, etc.).

For example, a user may perform various functions by using the input device of the cradle 2. By controlling the number of times that a user presses the input device or a period of time during which the input device is being pressed, a desired function from among the plurality of functions of the cradle 2 may be executed. As a user manipulates the input device, the cradle 2 may perform a function of preheating the heater 2130 of the holder 1, a function of regulating the temperature of the heater 2130 of the holder 1, a function of cleaning the space within the holder 1 in which a cigarette is inserted, a function of checking whether the cradle 2 is in an operable state, a function of displaying the remaining power (available power) of the battery 210 of the cradle 2, a function of resetting the cradle 2, etc. However, the functions of the cradle 2 are not limited to the examples described above.

Figure 18A:
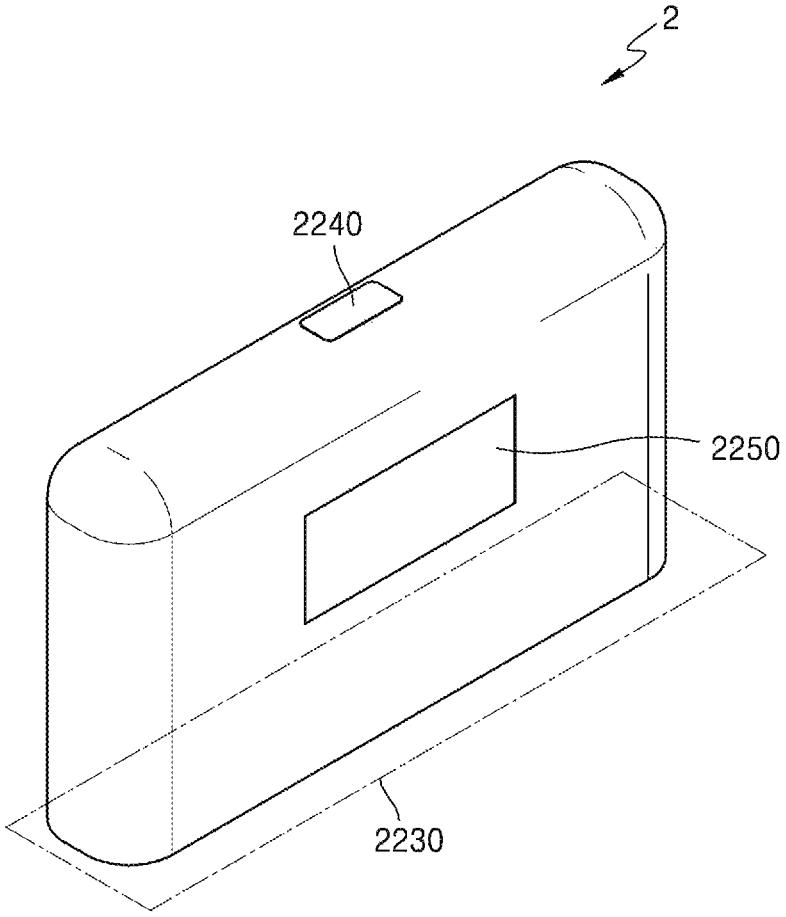
FIGS. 18A and 18B are diagrams showing various views of an example of a cradle.
Figure 18B:
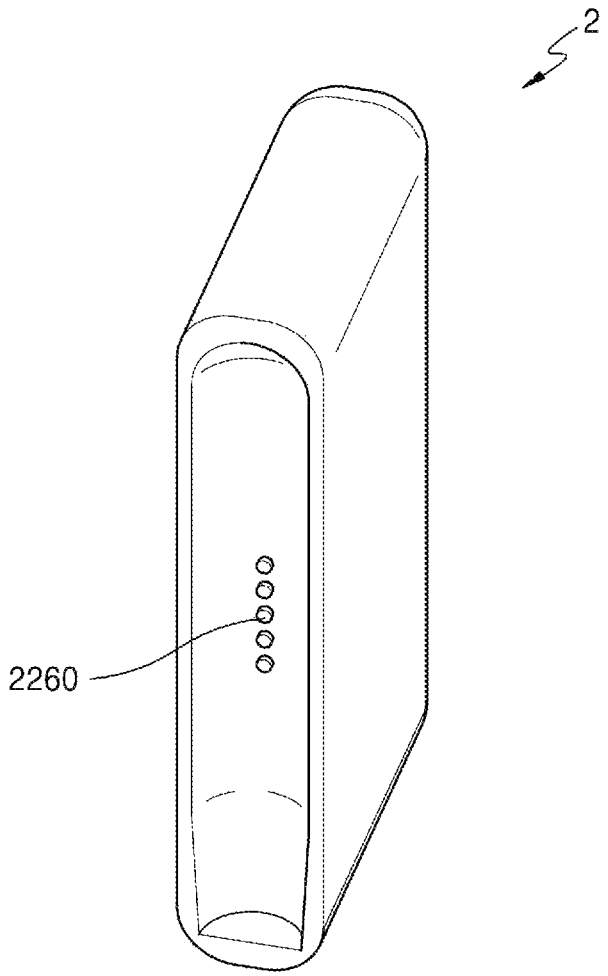

FIGS. 18A and 18B are diagrams showing various views of an example of a cradle.

FIG. 18A is a diagram showing an example of the cradle 2 viewed in a first direction. The space 2230 into which the holder 1 may be inserted may be formed on one side of the cradle 2. Also, the holder 1 may be inserted and fixed in the cradle 2 even when the cradle 2 does not include a separate fixing unit like a lid. The cradle 2 may also include a button 2240 for a user to control the cradle 2 and a display 2250 for outputting an image.

FIG. 18B is a diagram showing an example of the cradle 2 viewed in a second direction. The cradle 2 may include a terminal 2260 to be coupled with the inserted holder 1. The battery 110 of the holder 1 may be charged by power supplied by the battery 210 of the cradle 2 as the terminal 2260 is coupled with the terminal 2170 of the holder 1. Also, the holder 1 may be operated by power supplied from the battery 210 of the cradle 2 through the terminal 2170 and the terminal 2260 and transmission/reception of signals may be performed between the holder 1 and the cradle 2 through the terminal 2170 and the terminal 2260. For example, the terminal 2260 may include four micro pins, but the present disclosure is not limited thereto.

As described above, the holder 1 may be inserted into the inner space 2230 of the cradle 2. The holder 1 may be completely inserted into the cradle 2 or may be tilted while being inserted into the cradle 2. Hereinafter, examples in which the holder 1 is inserted into the cradle 2 will be described below.

Figure 19:
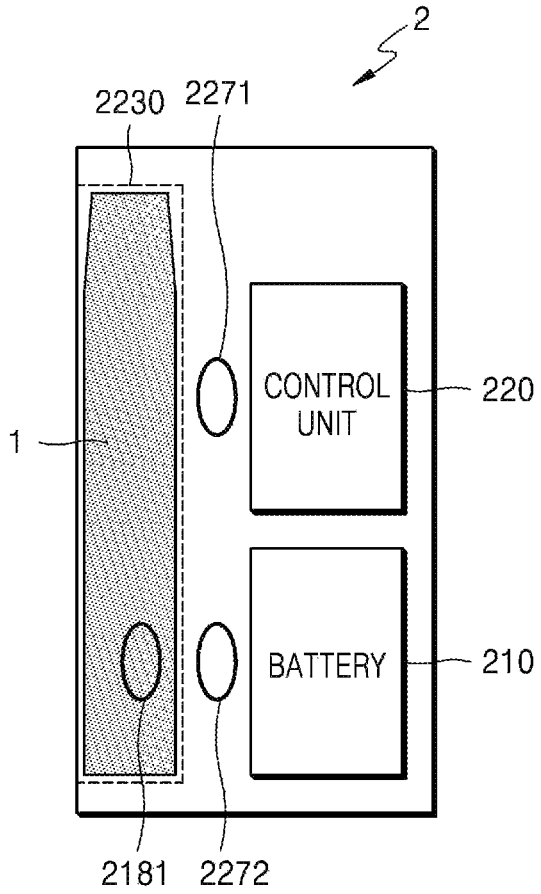
FIG. 19 is a diagram showing an example in which a holder is inserted into a cradle.

FIG. 19 is a diagram showing an example in which a holder is inserted into a cradle.

Referring to FIG. 19, an example in which the holder 1 is inserted into the cradle 2 is shown. Because the space 2230 into which the holder 1 is to be inserted is present on one side surface of the cradle 2, the inserted holder 1 may not be exposed to the outside by the other side surfaces of the cradle 2. Therefore, the cradle 2 may not include another component (e.g., a lid) for not exposing the holder 1 to the outside.

The cradle 2 may include at least one attaching member, namely, attaching members 2271 and 2272, to increase attachment strength with the holder 1. Also, at least one attaching member 2181 may be included in the holder 1. Here, the attaching members 2181, 2271, and 2272 may be magnets, but are not limited thereto. Although FIG. 19 shows that the holder 1 includes the single attaching member 2181 and the cradle 2 includes the two attaching members 2271 and 2272 for convenience of explanation, the number of attaching members 2181, 2271, and 2272 is not limited thereto.

The holder 1 may include the attaching member 2181 at a first position, and the cradle 2 may include the attaching members 2271 and 2272 at a second position and a third position, respectively. In this case, the first position and the third position may be positions facing each other when the holder 1 is inserted into the cradle 2.

Since the attaching members 2181, 2271, and 2272 are included in the holder 1 and the cradle 2, the holder 1 and the cradle 2 may be attached to each other more strongly even when the holder 1 is inserted into one side surface of the cradle 2. In other words, as the holder 1 and the cradle 2 further include the attaching members 2181, 2271, and 2272 in addition to the terminals 2170 and 2260, the holder 1 and the cradle 2 may be attached to each other more strongly. Therefore, even when there is no separate component (e.g., a lid) in the cradle 2, the inserted holder 1 may not be easily separated from the cradle 2.

Also, when the control unit 220 also determines that the holder 1 has been completely inserted into the cradle 2 through the terminals 2170 and 2260 and/or the attaching members 2181, 2271, and 2272, the control unit 220 may charge the battery 110 of the holder 1 by using the power of the battery 210.

Figure 20:
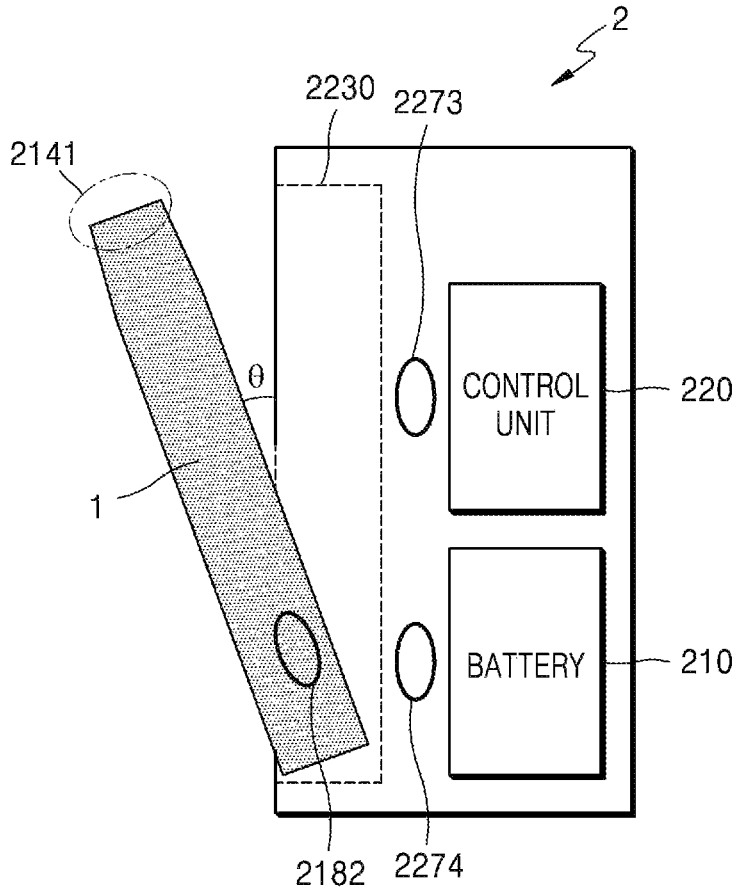
FIG. 20 is a diagram showing an example in which a holder is tilted while being inserted into a cradle.

FIG. 20 is a diagram showing an example in which a holder is tilted while being inserted into a cradle.

Referring to FIG. 20, the holder 1 is tilted inside the cradle 2. Here, the term 'tilting' indicates that the holder 1 is inclined at a certain angle in a state while the holder 1 is being inserted into the cradle 2.

As shown in FIG. 19, when the holder 1 is completely inserted into the cradle 2, a user is not able to smoke. In other words, once the holder 1 is completely inserted into the cradle 2, a cigarette may not be inserted into the holder 1.

Therefore, when the holder 1 is completely inserted into the cradle 2, a user is not able to smoke.

As shown in FIG. 20, when the holder 1 is tilted, the terminal end 2141 of the holder 1 is exposed to the outside. Therefore, the user may insert a cigarette into the terminal end 2141 and smoke generated aerosol. A sufficient tilting angle θ may be secured to prevent a cigarette from being bent or damaged when the cigarette is inserted into the terminal end 2141 of the holder 1. For example, the holder 1 may be tilted at an angle to the extent that an entire cigarette insertion hole included in the terminal end 2141 may be exposed to the outside. For example, the range of the tilting angle θ may be greater than 0° and not greater than 180° and may preferably be not less than 10° and not greater than 90°. More preferably, the range of the tilting angle θ may be from 10° to 20°, from 10° to 30°, from 10° to 40°, from 10° to 50°, or from 10° to 60°.

Also, even when the holder 1 is tilted, the terminal 2170 of the holder 1 and the terminal 2260 of the cradle 2 are coupled with each other. Therefore, the heater 2130 of the holder 1 may be heated by power supplied by the battery 210 of the cradle 2. Therefore, the holder 1 may generate aerosol by using the battery 210 of the cradle 2 even when the remaining power of the battery 110 of the holder 1 is low or the battery 110 of the holder 1 is completely discharged.

FIG. 20 shows an example in which the holder 1 includes a single attaching member 2182 and the cradle 2 includes two attaching members 2273 and 2274. For example, the respective positions of the attaching members 2182, 2273, and 2274 are as described above with reference to FIG. 19. Assuming that the attaching members 2182, 2273, and 2274 are magnets, the magnetic strength of the attaching member 2274 may be greater than the magnetic strength of the attaching member 2273. Therefore, the holder 1 may not be completely separated from the cradle 2 due to the attaching member 2182 and the attaching member 2274 even when the holder 1 is tilted.

Also, when the control unit 220 also determines that the holder 1 has been tilted by the terminals 2170 and 2260 and/or the attaching members 2182, 2273, and 2274, the control unit 220 may heat the heater 2130 of the holder 1 or charge the battery 110 by using the power of the battery 210.

Figure 21A:
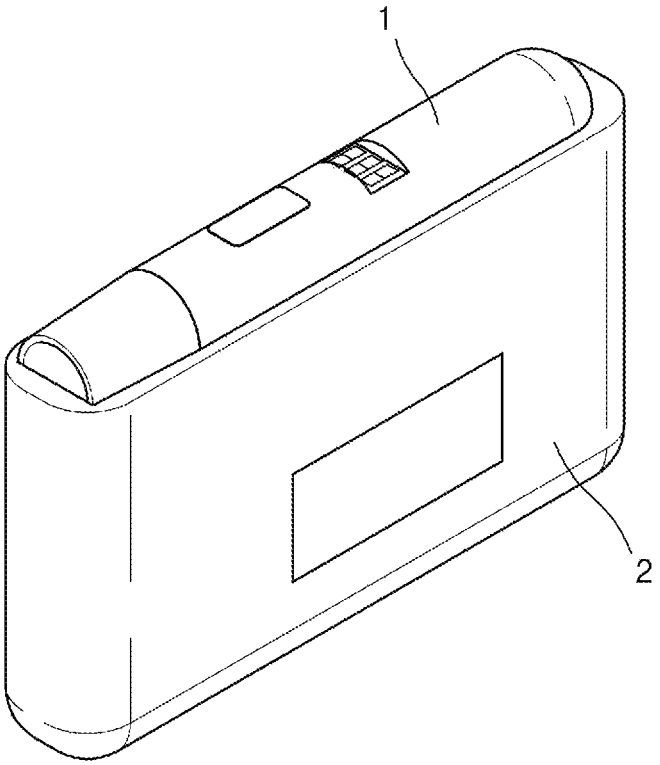
FIGS. 21A and 21B are diagrams showing examples in which a holder is inserted into a cradle.
Figure 21B:
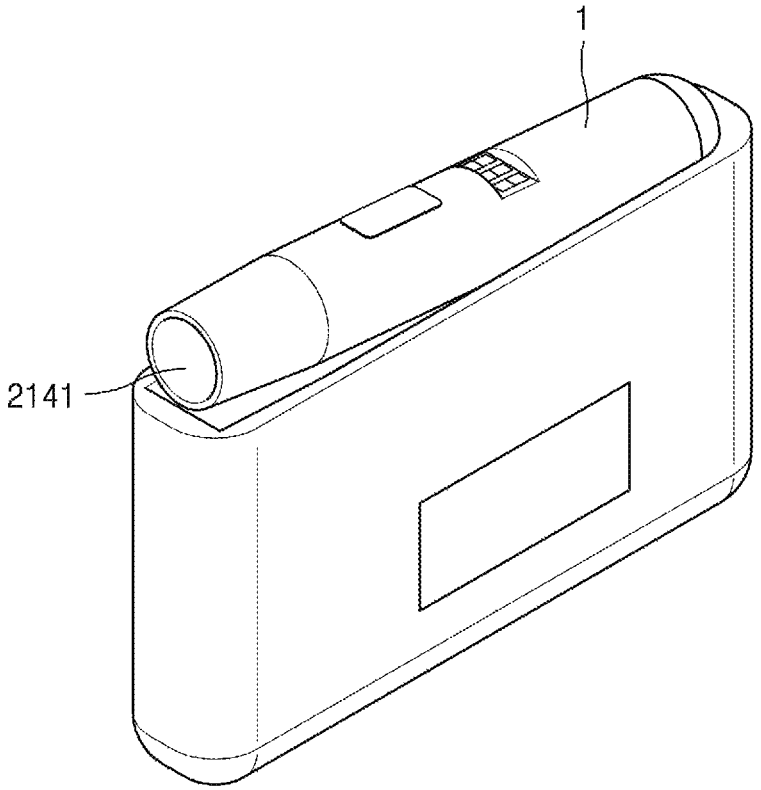

FIGS. 21A and 21B are diagrams showing examples in which a holder is inserted into a cradle.

FIG. 21A shows an example in which the holder 1 is completely inserted into the cradle 2. The cradle 2 may be fabricated to provide the sufficient inner space 2230 of the cradle 2 to minimize the contact of a user with the holder 1 when the holder 1 is completely inserted into the cradle 2. When the holder 1 is completely inserted into the cradle 2, the control unit 220 supplies power of the battery 210 to the holder 1, such that the battery 110 of the holder 1 is charged.

FIG. 21B shows an example in which the holder 1 is tilted while being inserted into the cradle 2. When the holder 1 is tilted, the control unit 220 supplies power of the battery 210 to the holder 1, such that the battery 110 of the holder 1 is charged or the heater 2130 of the holder 1 is heated.

Figure 22:
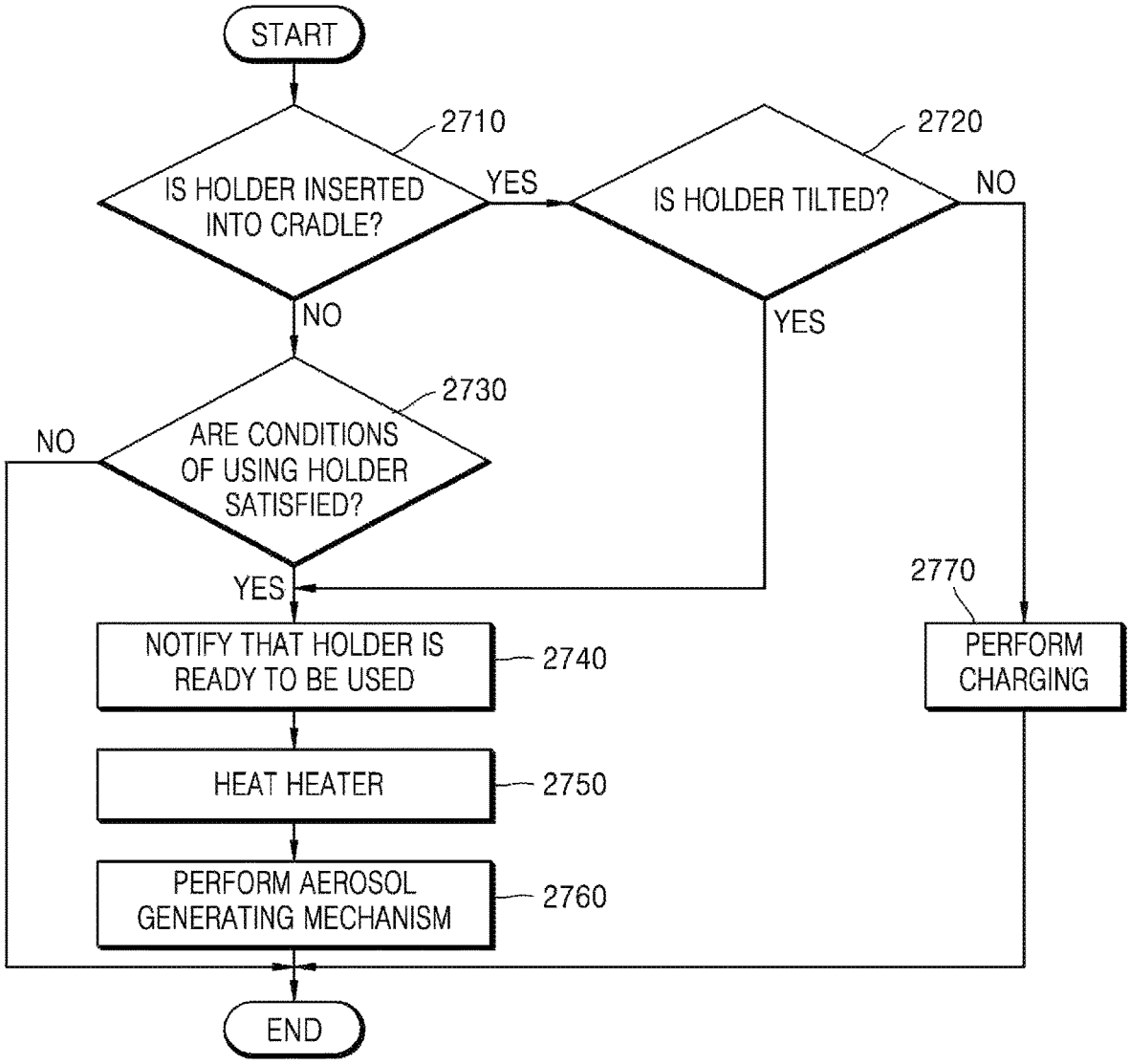
FIG. 22 is a flowchart for describing an example in which a holder and a cradle operate.

FIG. 22 is a flowchart for describing an example in which a holder and a cradle operate.

A method of generating aerosols shown in FIG. 22 includes operations that are performed in a time-series manner by the holder 1 of FIG. 15 or the cradle 2 of FIG. 17. Therefore, it will be understood that the descriptions given above with respect to the holder 1 of FIG. 15 and the cradle 2 of FIG. 17 also apply to the method of FIG. 22, even when the descriptions are omitted below.

In operation 2710, the holder 1 determines whether it is inserted into the cradle 2. For example, the control unit 120 may determine whether the holder 1 is inserted into the cradle 2, based on whether the terminals 2170 and 2260 of the holder 1 and the cradle 2 are connected to each other and/or whether the attaching members 2181, 2271, and 2272 are operating.

When the holder 1 has been inserted into the cradle 2, the method proceeds to operation 2720. When the holder 1 has been separated from the cradle 2, the method proceeds to operation 2730.

In operation 2720, the cradle 2 determines whether the holder 1 is tilted. For example, the control unit 220 may determine whether the holder 1 is tilted, based on whether the terminals 2170 and 2260 of the holder 1 and the cradle 2 are connected to each other and/or whether the attaching members 2182, 2273, and 2274 are operating.

Although it is described that the cradle 2 determines whether the holder 1 is tilted in operation 2720, the present disclosure is not limited thereto. In other words, the control unit 120 of the holder 1 may determine whether the holder 1 is tilted.

When the holder 1 is tilted, the method proceeds to operation 2740. When the holder 1 is not tilted (i.e., when the holder 1 is completely inserted into the cradle 2), the method proceeds to operation 2770.

In operation 2730, the holder 1 determines whether conditions of using the holder 1 are satisfied. For example, the control unit 120 may determine whether the conditions for using the holder 1 are satisfied, by checking the remaining power of the battery 110 and checking whether other components of the holder 1 may be normally operated.

When the conditions for using the holder 1 are satisfied, the method proceeds to operation 2740. Otherwise, the method is terminated.

In operation 2740, the holder 1 informs a user that the holder 1 is ready to be used. For example, the control unit 120 may output an image indicating that the holder 1 is ready to be used on the display of the holder 1, or may control the motor of the holder 1 to generate a vibration signal.

In operation 2750, the heater 2130 is heated. For example, when the holder 1 is separated from the cradle 2, the heater 2130 may be heated by power of the battery 110 of the holder 1. In another example, when the holder 1 is tilted, the heater 2130 may be heated by power of the battery 210 of the cradle 2.

The control unit 120 of the holder 1 or the control unit 220 of the cradle 2 may check the temperature of the heater 2130 in real time and control an amount of power supplied to the heater 2130 and a time period for supplying the power to the heater 2130. For example, the control unit 120 or 220 may check the temperature of the heater 2130 in real time through a temperature sensor included in the holder 1 or an electrically conductive track of the heater 2130.

In operation 2760, the holder 1 performs an aerosol generation mechanism. For example, the control unit 120 or 220 may check the temperature of the heater 2130, which changes as a user performs puffs, and adjust an amount of power supplied to the heater 2130 or stop supplying power to the heater 2130. Also, the control unit 120 or 220 may count the number of puffs of the user, and output information indicating that the holder 1 needs to be cleaned when the number of puffs reaches a certain number of times (e.g., 1500 times).

In operation 2770, the cradle 2 performs charging of the holder 1. For example, the control unit 220 may charge the holder 1 by supplying power of the battery 210 of the cradle 2 to the battery 110 of the holder 1.

Meanwhile, the control unit 120 or 220 may stop the operation of the holder 1 according to the number of puffs of the user or the operation time of the holder 1. Hereinafter, an example in which the control unit 120 or 220 stops the operation of the holder 1 will be described with reference to FIG. 23.

Figure 23:
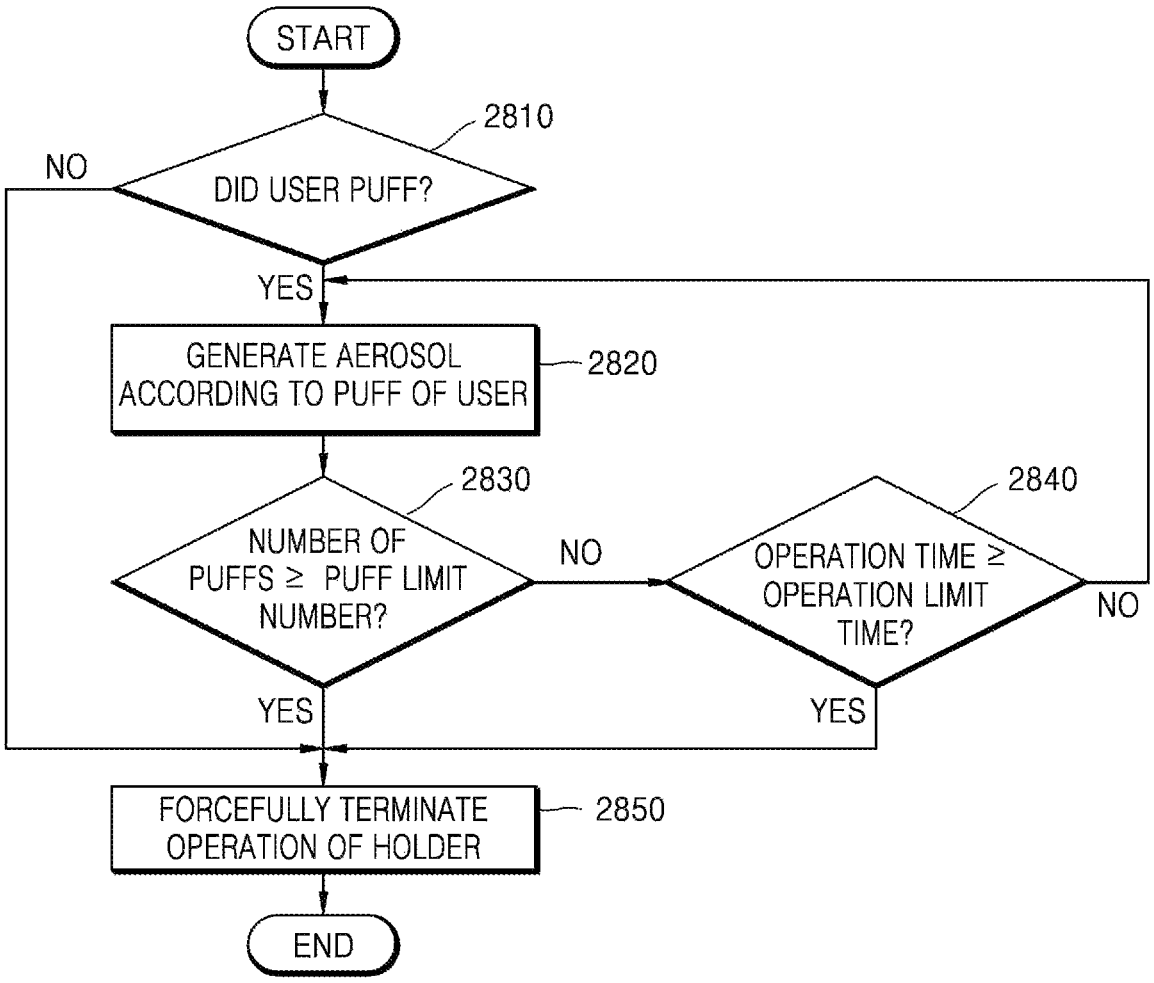
FIG. 23 is a flowchart for describing an example in which a holder operates.

FIG. 23 is a flowchart for describing another example in which a holder operates.

A method of generating aerosols shown in FIG. 23 includes operations that are performed in a time-series manner by the holder 1 of FIG. 15 or the cradle 2 of FIG. 17. Therefore, it will be understood that the descriptions given above with respect to the holder 1 of FIG. 15 and the cradle 2 of FIG. 17 also apply to the method of FIG. 23, even when the descriptions are omitted below.

In operation 2810, the control unit 120 or 220 determines whether a user puffed. For example, the control unit 120 or 220 may determine whether the user puffed through the puff detecting sensor included in the holder 1.

In operation 2820, aerosol is generated according to the puff of the user. The control unit 120 or 220 may adjust power supplied to the heater 2130 according to the puff of the user and the temperature of the heater 2130, as described above with reference to FIG. 22. Also, the control unit 120 or 220 counts the number of puffs of the user.

In operation 2830, the control unit 120 or 220 determines whether the number of puffs of the user is equal to or greater than a puff limit number. For example, assuming that the puff limit number is set to 14 times, the control unit 120 or 220 determines whether the number of counted puffs is 14 times or more.

When the number of puffs of the user is close to the puff limit number (e.g., when the number of puffs of the user is 12), the control unit 120 or 220 may output a warning signal through a display or a vibration motor.

When the number of puffs of the user is equal to or greater than the puff limit number, the method proceeds to operation 2850. When the number of puffs of the user is less than the puff limit number, the method proceeds to operation 2840.

In operation 2840, the control unit 120 or 220 determines whether the operation time of the holder 1 is equal to or greater than an operation limit time. Here, the operation time of the holder 1 refers to an accumulated time from a time point at which the holder 1 started its operation to a current time point. For example, assuming that the operation limit time is set to 10 minutes, the control unit 120 or 220 determines whether the holder 1 is operating for 10 minutes or longer.

When the operation time of the holder 1 is close to the operation limit time (e.g., when the holder 1 is operating for 8 minutes), the control unit 120 or 220 may output a warning signal through a display or a vibration motor.

When the holder 1 is operating for the operation limit time or longer, the method proceeds to operation 2850. When the operation time of the holder 1 is less than the operation limit time, the method proceeds to operation 2820.

In operation 2850, the control unit 120 or 220 forcibly terminates the operation of the holder 1. In other words, the control unit 120 or 220 terminates the aerosol generation mechanism of the holder 1. For example, the control unit 120 or 220 may forcibly terminate the operation of the holder 1 by interrupting the power supplied to the heater 2130.

Figure 24:
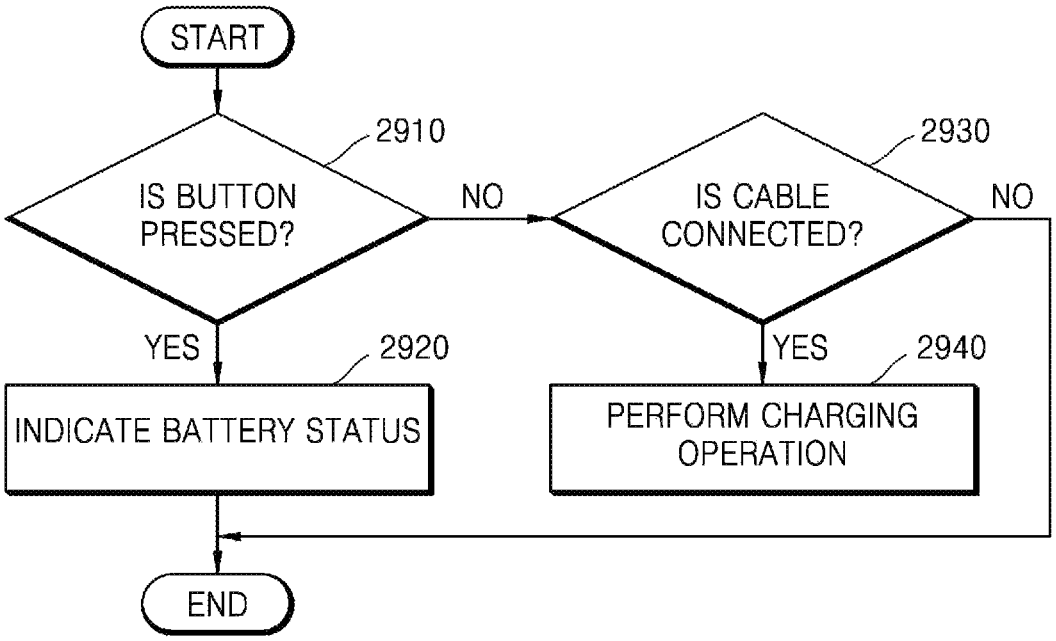
FIG. 24 is a flowchart for describing an example in which a cradle operates.

FIG. 24 is a flowchart for describing an example in which a cradle operates.

The flowchart shown in FIG. 24 includes operations that are performed in a time-series manner by the cradle 2 shown in FIG. 17. Therefore, it will be understood that the descriptions given above with respect to the cradle 2 shown in FIG. 17 also apply to the method of FIG. 24, even when the descriptions are omitted below.

Although not shown in FIG. 24, the operation of the cradle 2 to be described below may be performed regardless of whether the holder 1 is inserted into the cradle 2.

In operation 2910, the control unit 220 of the cradle 2 determines whether the button 2240 is pressed. When the button 2240 is pressed, the method proceeds to operation 2920. When the button 2240 is not pressed, the method proceeds to operation 2930.

In operation 2920, the cradle 2 indicates the status of a battery. For example, the control unit 220 may output information regarding the current state of the battery 210 (e.g., remaining power, etc.) on the display 2250.

In operation 2930, the control unit 220 of the cradle 2 determines whether a cable is connected to the cradle 2. For example, the control unit 220 determines whether a cable is connected to an interface (e.g., a USB port, etc.) included in the cradle 2. When a cable is connected to the cradle 2, the method proceeds to operation 2940. Otherwise, the method is terminated.

In operation 2940, the cradle 2 performs a charging operation. For example, the cradle 2 charges the battery 210 by using power supplied through a connected cable.

As described above, a cigarette may be inserted into the holder 1. The cigarette includes an aerosol generating material and aerosol is generated by the heated heater 2130.

Hereinafter, an example of a cigarette that may be inserted into the holder 1 will be described with reference to FIGS. 25 to 27C.

Figure 25:
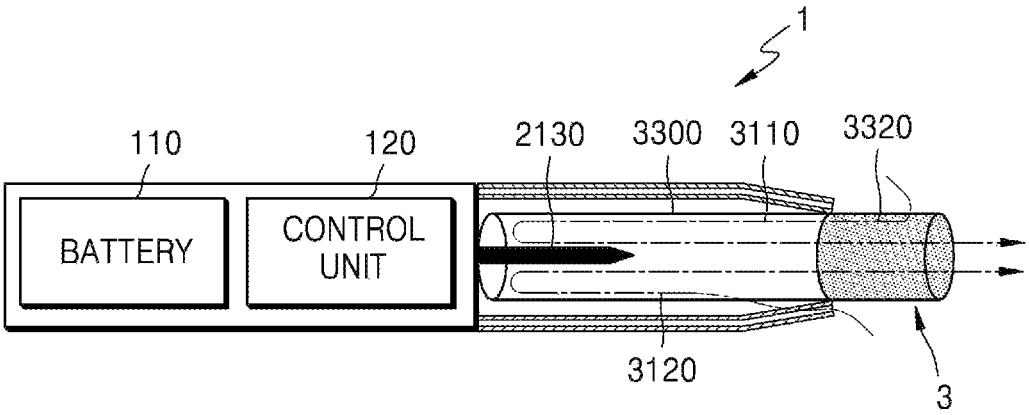
FIG. 25 is a diagram showing an example in which a cigarette is inserted into a holder.

FIG. 25 is a diagram showing an example in which a cigarette is inserted into a holder.

Referring to FIG. 25, a cigarette 3 may be inserted into the holder 1 through the terminal end 2141 of the casing 2140. When the cigarette 3 is inserted into the holder 1, the heater 2130 is located inside the cigarette 3. Therefore, the heated heater 2130 heats the aerosol generating material of the cigarette 3, thereby generating aerosol.

The cigarette 3 may be similar to a typical burning cigarette. For example, the cigarette 3 may include a first portion 3310 containing an aerosol generating material and a second portion 3320 including a filter and the like. Meanwhile, the cigarette 3 according to one embodiment may also include an aerosol generating material in the second portion 3320. For example, an aerosol generating material in the form of granules or capsules may be inserted into the second portion 3320.

The entire first portion 3310 may be inserted into the holder 1 and the second portion 3320 may be exposed to the outside. Alternatively, only a portion of the first portion 3310 may be inserted into the holder 1 or the entire first portion 3310 and a portion the second portion 3320 may be inserted into the holder 1.

A user may inhale the aerosol while holding the second portion 3320 by his/her lips. At this time, the aerosol is mixed with the outside air and is delivered to a user's mouth. As shown in FIG. 25, the outside air may be introduced (3110) through at least one hole formed in the surface of the cigarette 3, and holder 1 or may be introduced (3120) through at least one air passage formed in the holder 1. For example, the opening and closing of the air passage formed in the holder 1 and/or the size of the air passage may be adjusted by a user.

Figure 26A:
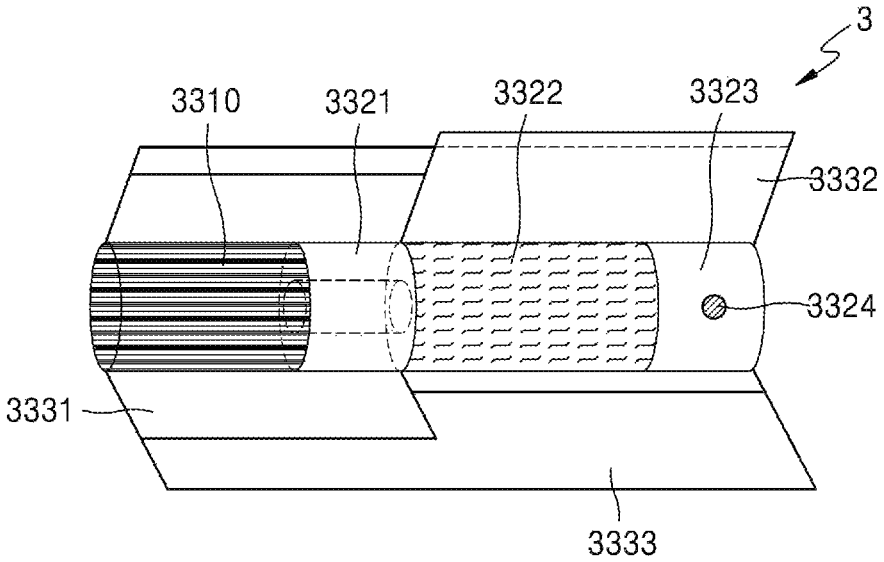
FIGS. 26A and 26B are block diagrams showing examples of a cigarette.
Figure 26B:
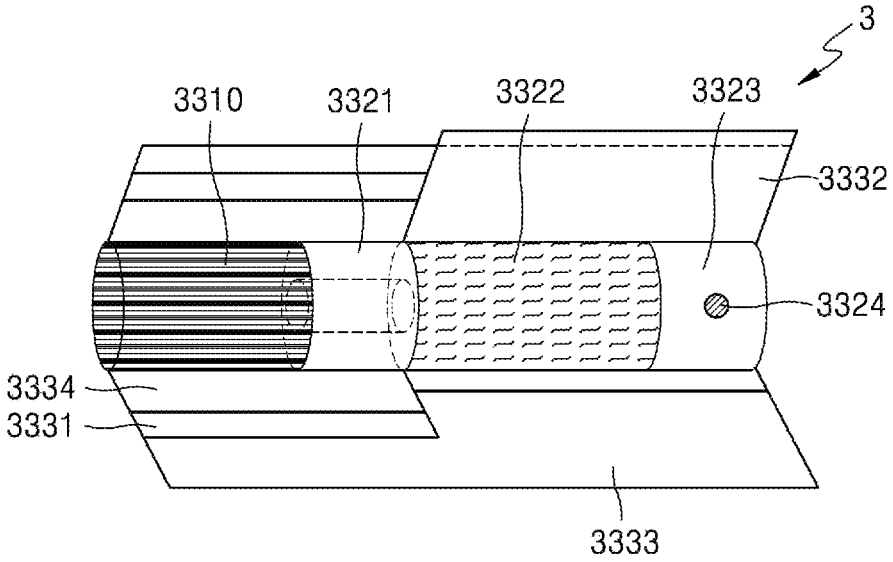

FIGS. 26A and 26B are block diagrams showing examples of a cigarette.

Referring to FIGS. 26A and 26B, the cigarette 3 includes a tobacco rod 3300, a first filter segment 3321, a cooling structure 3322, and a second filter segment 3323. The first portion 3310 described above with reference to FIG. 25 includes the tobacco rod 310 and the second portion 3320 includes the first filter segment 3321, the cooling structure 3322, and the second filter segment 3323.

Comparing FIGS. 26A and 26B, the cigarette 3 of FIG. 26B further includes a fourth wrapper 3334 in contrast with the cigarette 3 of FIG. 26A.

The structures of the cigarette 3 shown in FIGS. 26A and 26B are merely examples, and some of the components may be omitted. For example, the cigarette 3 may not include one or more of the first filter segment 3321, the cooling structure 3322, and the second filter segment 3323.

The tobacco rod 3300 includes an aerosol generating material. For example, the aerosol generating material may include at least one of glycerin, propylene glycol, ethylene glycol, dipropylene glycol, diethylene glycol, triethylene glycol, tetraethylene glycol, and oleyl alcohol. The length of the tobacco rod 3300 may be in the range of about 7 mm to about 15 mm, but, preferably, may be about 12 mm. The diameter of the tobacco rod 3300 may be in the range of about 7 mm to about 9 mm, but, preferably, may be about 7.9 mm. The diameter and length of the tobacco rod 3300 are not limited thereto.

In addition, the tobacco rod 3300 may include other additive materials like a flavoring agent, a wetting agent, and/or an acetate compound. For example, the flavoring agent may include licorice, sucrose, fructose syrup, isosweet, cocoa, lavender, cinnamon, cardamom, celery, fenugreek, cascara, sandalwood, bergamot, geranium, honey essence, rose oil, vanilla, lemon oil, orange oil, mint oil, cinnamon, keragene, cognac, jasmine, chamomile, menthol, cinnamon, ylang ylang, salvia, spearmint, ginger, coriander, coffee, etc. In addition, the wetting agent may include glycerin or propylene glycol.

For example, the tobacco rod 3300 may be filled with cut tobacco leaves. Here, cut tobacco leaves may be formed by fine-cutting a tobacco sheet.

For a large wide tobacco sheet to be filled within the tobacco rod 3300 having a narrow space, a special operation for facilitating folding of the tobacco sheet is further needed. Therefore, it is easier to fill the tobacco rod 3300 with cut tobacco leaves than to fill the tobacco rod 3300 with a tobacco sheet, and thus the productivity and the efficiency of the process for producing the tobacco rod 3300 may be improved.

In another example, the tobacco rod 3300 may be filled with a plurality of cigarette strands formed by fine-cutting a tobacco sheet. For example, the tobacco rod 3300 may be formed by combining a plurality of tobacco strands in the same direction (parallel to one another) or randomly. The tobacco strands may be fabricated to each have a cuboidal shape having a horizontal length of 1 mm, a vertical length of 12 mm, and a thickness (height) of 0.1 mm, but the present disclosure is not limited thereto.

When the tobacco rod 3300 is filled with tobacco strands, more aerosol may be generated than when the tobacco rod 3300 is filled with a tobacco sheet. In the case of filling the same space, compared to a tobacco sheet, tobacco strands ensure a greater surface area. A greater surface area indicates that an aerosol generating material has a greater chance of contacting the outside air. Therefore, when the tobacco rod 3300 is filled with tobacco strands, more aerosol may be generated than when the tobacco rod 3300 is filled with a tobacco sheet.

Furthermore, the cigarette 3 may be more easily separated from the holder 1 when the tobacco rod 3300 is filled with tobacco strands than when the tobacco rod 3300 is filled with a tobacco sheet. Compared with a tobacco sheet, tobacco strands generate a small frictional force by contacting the heater 2130. Therefore, when the tobacco rod 3300 is filled with tobacco strands, the cigarette 3 may be more easily separated from the holder 1 than when the tobacco rod 3300 is filled with a tobacco sheet.

A tobacco sheet may be formed by pulverizing a raw tobacco material to form a slurry and then drying the slurry. For example, a 15% to 30% aerosol generating material may be added to the slurry. The raw tobacco material may be tobacco leaf fragments, tobacco stems, fine tobacco powders formed during treatment of tobacco, and/or main lateral strips of tobacco leaves. The tobacco sheet may also include other additives like wood cellulose fibers.

The first filter segment 3321 may be a cellulose acetate filter. For example, the first filter segment 3321 may have a tubular structure including a hollow formed therein. The length of the first filter segment 3321 may be within the range of about 7 mm to about 15 mm, but may be preferably about 7 mm. The length of the first filter segment 3321 may be smaller than about 7 mm, but it is preferable that the first filter segment 3321 has a length such that a function of at least one cigarette element (e.g., a cooling element, a capsule, an acetate filter, etc.) is not damaged. However, the length of the first filter segment 3321 is not limited to the aforementioned numerical ranges. The length of the first filter segment 3321 may be expanded, and the length of the entire cigarette 3 may be adjusted according to the length of the first filter segment 3321.

The second filter segment 3323 may also be a cellulose acetate filter. For example, the second filter segment 3323 may be fabricated as a recess filter with a hollow cavity, but is not limited thereto. The length of the second filter segment 3323 may be within the range of about 5 mm to about 15 mm, but may be preferably about 12 mm. However, the length of the second filter segment 3323 is not limited to the aforementioned numerical ranges.

Also, the second filter segment 3323 may include at least one capsule 3324. Here, the capsule 3324 may have a structure in which a content liquid containing a flavoring material is wrapped with a film. For example, the capsule 3324 may have a spherical or cylindrical shape. The diameter of the capsule 3324 may be no less than 2 mm, but, preferably, may be about 2 to 4 mm.

A material used to form the film of the capsule 3324 may be starch and/or a gelling agent. For example, gellan gum or gelatin may be used as the gelling agent. A gelling agent may be further used as a material for forming the film of the capsule 3324. Here, as the gelling auxiliary agent, for example, a calcium chloride may be used. Furthermore, a plasticizer may be further used as a material for forming the film of the capsule 3324. As the plasticizer, glycerin and/or sorbitol may be used. Furthermore, a coloring agent may be further used as a material for forming the film of the capsule 3324.

For example, as a flavoring material included in the content liquid of the capsule 3324, menthol, plant essential oil, and the like may be used. As a solvent of the flavoring material included in the content liquid, for example, a medium chain fatty acid triglyceride (MCT) may be used.

Also, the content liquid may include other additives like a pigment, an emulsifying agent, a thickening agent, etc.

The cooling structure 3322 cools aerosol generated as the heater 2130 heats the tobacco rod 3300. Therefore, a user may inhale aerosol cooled to a suitable temperature. The length of the cooling structure 3322 may be in the range of about 10 mm to about 20 mm, but preferably, may be about 14 mm. However, the length of the cooling structure 3322 is not limited to the aforementioned numerical ranges.

For example, the cooling structure 1322 may be fabricated using polylactic acid. To increase the surface area per unit area (i.e., the surface area contacting aerosol), the cooling structure may be fabricated in various shapes. Various examples of the cooling structure 3322 will be described later with reference to FIGS. 27A through 27F.

The tobacco rod 3300 and the first filter segment 3321 are wrapped by a first wrapper 3331. For example, the first wrapper 3331 may be made of an oil-resistant paper packaging material.

The cooling structure 3322 and the second filter segment 3323 are wrapped by a second wrapper 3332. The entire cigarette 3 may be re-wrapped by a third wrapper 3333. For example, the second wrapper 3332 and the third wrapper 3333 may be made of a general paper packaging material. Selectively, the second wrapper 3332 may be made of an oil-resistant hard wrapping paper or a PLA flavored paper. The second wrapper 3332 may wrap the second filter segment 3323 and may further wrap the second filter segment 3323 and the cooling structure 3322.

Referring to FIG. 26B, the cigarette 3 may include the fourth wrapper 3334. At least one of the tobacco rod 3300 and the first filter segment 3321 may be wrapped by the fourth wrapper 3334. In other words, only the tobacco rod 3300 may be wrapped by the fourth wrapper 3334, or both the tobacco rod 3300 and the first filter segment 3321 may be wrapped by the fourth wrapper 3334. For example, the fourth wrapper 3334 may be made of a paper packaging material.

The fourth wrapper 3334 may be produced by applying (or coating) a predetermined material to (or on) one surface or both surfaces of a paper packaging material. Here, an example of the predetermined material may be, but is not limited to, silicon. Silicon exhibits characteristics like heat resistance with little change due to the temperature, oxidation resistance, resistances to various chemicals, water repellency, electrical insulation, or the like. However, any material other than silicon may be applied to (or coated on) the fourth wrapper 3334 without limitation as long as the material exhibits the above-mentioned characteristics.

Although the cigarette 3 includes both the first wrapper 3331 and the fourth wrapper 3334 in FIG. 26B, the cigarette 3 is not limited thereto. In other words, the cigarette 3 may include only one of the first wrapper 3331 and the fourth wrapper 3334.

The fourth wrapper 3334 may prevent the cigarette 3 from being burned. For example, when the tobacco rod 3300 is heated by the heater 2130, there is a possibility that the cigarette 3 is burned. In detail, when the temperature is raised to a temperature above the ignition point of any one of the materials included in the tobacco rod 3300, the cigarette 3 may be burned. Even in this case, because the fourth wrapper 3334 includes a non-combustible material, the burning of the cigarette 3 may be prevented.

Furthermore, the fourth wrapper 3334 may prevent the holder 1 from being contaminated by substances formed by the cigarette 3. Through puffs of a user, liquid substances may be formed in the cigarette 3. For example, as the aerosol formed by the cigarette 3 is cooled by the outside air, liquid materials (e.g., moisture, etc.) may be formed. As the fourth wrapper 3334 wraps the tobacco rod 3300 and/or the first filter segment 3321, the liquid materials formed in the cigarette 3 may be prevented from being leaked out of the cigarette 3. Accordingly, the casing 2140 and the like of the holder 1 may be prevented from being contaminated by the liquid materials formed by the cigarette 3.

FIGS. 27A to 27F are diagrams for describing examples of a cooling structure of a cigarette.

For example, the cooling structures of FIGS. 27A through 27F may be fabricated using fibers made of pure polylactic acid (PLA).

For example, when a film (sheet)-type cooling structure is fabricated by filling a film (sheet), the film (sheet)-type cooling structure may be crushed by an external impact. In this case, the aerosol cooling effect of the cooling structure is deteriorated.

As another example, when a cooling structure is manufactured through extrusion molding or the like, the efficiency of the process is lowered due to addition of operations like cutting of a structure. Also, there are limits in manufacturing a cooling structure in various shapes.

As a cooling structure according to an embodiment is fabricated by using polylactic acid fibers (e.g., weaving), the risk of the cooling structure being deformed or losing its function by an external impact may be reduced. Also, by changing the way of combining the fibers, cooling structures having various shapes may be fabricated.

Furthermore, by fabricating a cooling structure by using fibers, the surface area contacting with aerosol is increased. Therefore, the aerosol cooling effect of the cooling structure may be further improved.

Figure 27A:
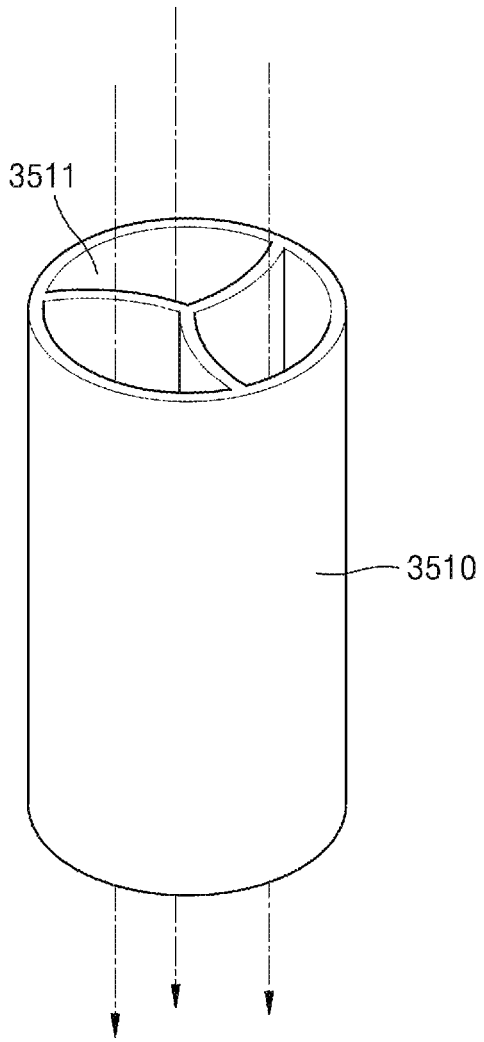
FIGS. 27A to 27F are diagrams for describing examples of a cooling structure of a cigarette.

Referring to FIG. 27A, a cooling structure 3510 may be fabricated to have a cylindrical shape, and at least one air passage 3511 may be formed in the cross-section of the cooling structure 3510.

Figure 27B:
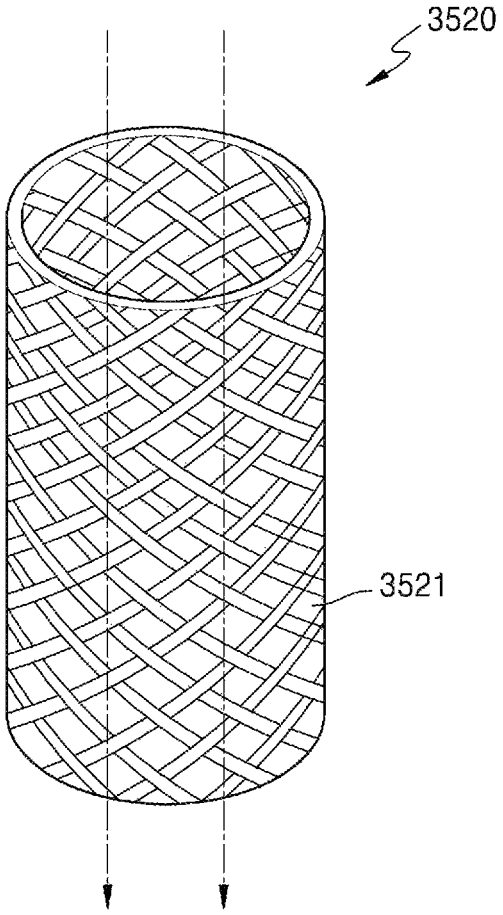

Referring to FIG. 27B, a cooling structure 3520 may be fabricated as a structure in which a plurality of fibers are interlaced with each other. In this case, aerosol may flow between the fibers and a vortex may be formed depending on the shape of the cooling structure 3520. The vortex expands an area of contact of the aerosol in the cooling structure 3100 and increases the time that the aerosol stays in the cooling structure 3100. Therefore, heated aerosol may be effectively cooled.

Figure 27C:
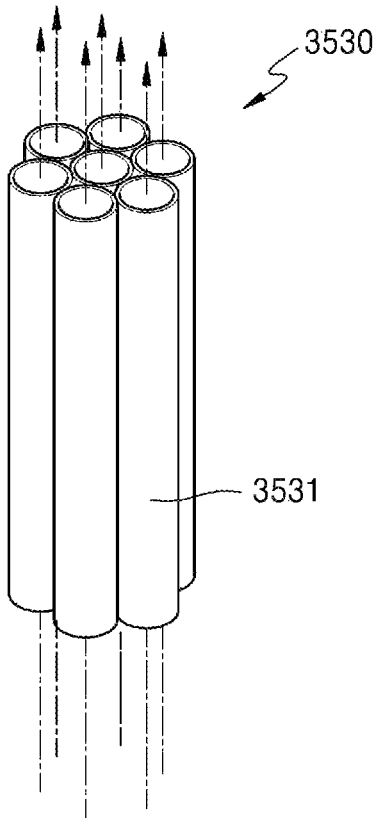

Referring to FIG. 27C, a cooling structure 3530 may be fabricated in the form of a gathering of a plurality of strands 3531.

Figure 27D:
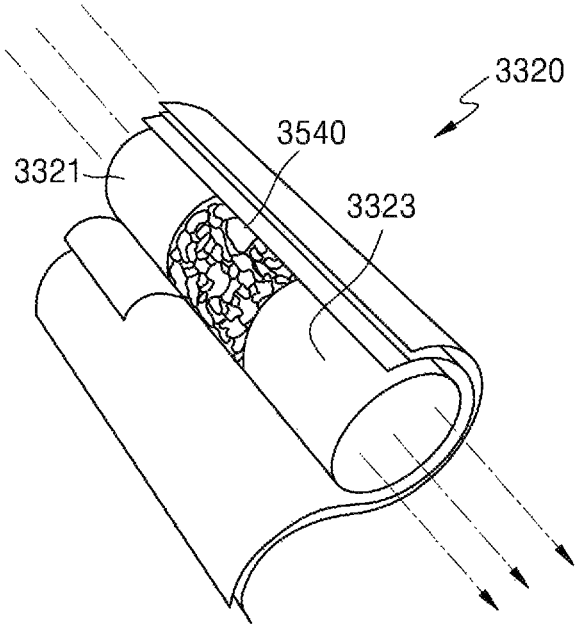

Referring to FIG. 27D, a cooling structure 3540 may be filled with granules formed of polylactic acid, cut leaves, or charcoal. Also, the granules may be fabricated by using a mixture of polylactic acid, cut leaves, and charcoal. On the other hand, the granules may further include an element capable of increasing the aerosol cooling effect other than polylactic acid, the cut leaves, and/or charcoal.

Figure 27E:
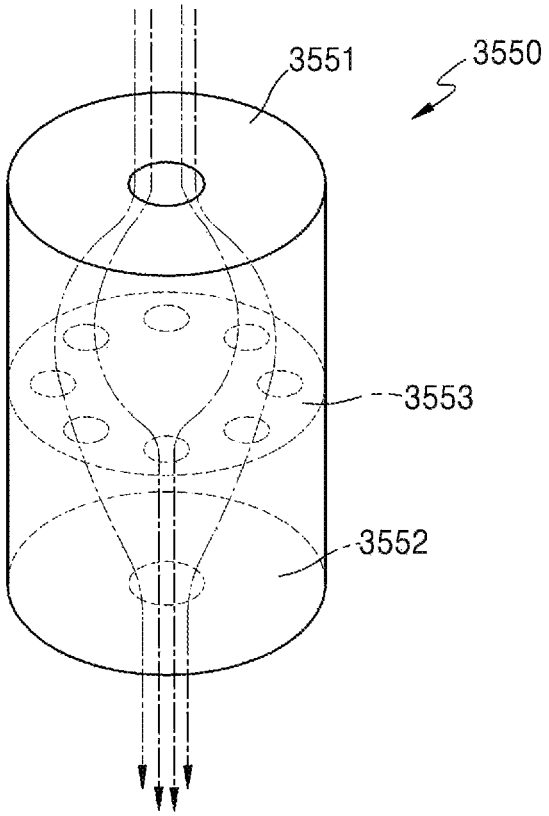

Referring to FIG. 27E, a cooling structure 3550 may include a first cross-section 3551 and a second cross-section 3552.

The first cross-section 3551 borders on the first filter segment 3321 and may include a gap into which aerosol is introduced. The second cross-section 3552 borders on the second filter segment 3323 and may include a gap into which aerosol may be released. For example, each of the first cross-section 3551 and the second cross-section 3552 may include a single gap having the same diameter, but the diameters and the numbers of the gaps included in the first cross-section 3551 and the second cross-section 3552 are not limited thereto.

In addition, the cooling structure 3550 may include a third cross-section 3553 including a plurality of gaps between the first cross-section 3551 and the second cross-section 3552. For example, the diameters of the plurality of gaps included in the third cross-section 3553 may be smaller than the diameters of the gaps included in the first cross-section 3551 and the second cross-section 3552. Also, the number of gaps included in the third cross-section 3553 may be greater than the number of gaps included in the first cross-section 3551 and the second cross-section 3552.

Figure 27F:
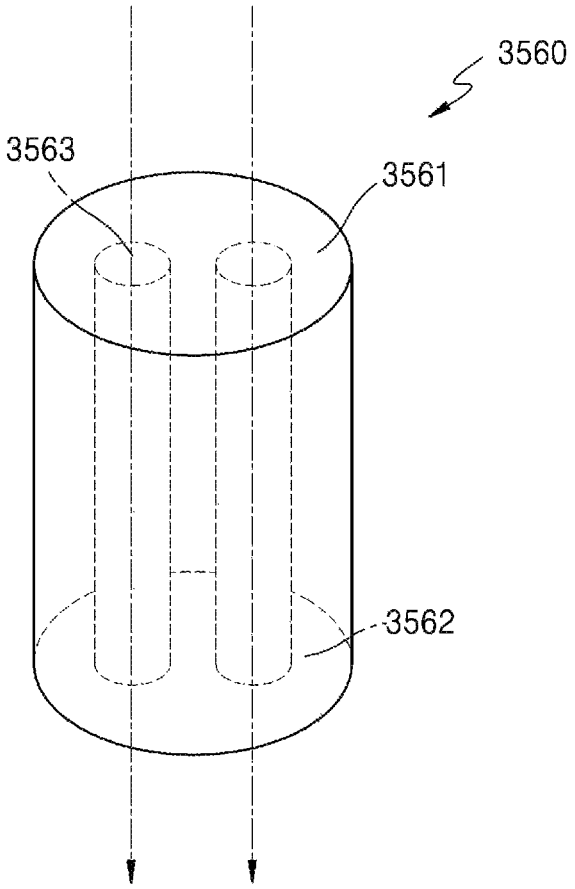

Referring to FIG. 27F, a cooling structure 3560 may include a first cross-section 3561 that borders on the first filter segment 3321, and a second cross-section 3562 that borders on the second filter segment 3323. Also, the cooling structure 3560 may include one or more tubular elements 3563. For example, the tubular elements 3563 may penetrate through the first cross-section 3561 and the second cross-section 3562. Also, the tubular elements 3563 may be packaged with a microporous packaging material and filled with a filler material (e.g., the granules described above with reference to FIG. 27D) that may increase the aerosol cooling effect.

The above-described methods can be written as computer programs and can be implemented in general-use digital computers that execute the programs using a computer readable recording medium. A structure of the data used in the above-described methods may be recorded in a computer readable recording medium in several ways. Examples of the computer readable recording medium include magnetic storage media (e.g., ROM, RAM, USB, floppy disks, hard disks, etc.), optical recording media (e.g., CD-ROMs, or DVDs), etc.

It will be understood by those of ordinary skill in the art that various changes in form and details may be made to the present embodiment without departing from the intrinsic characteristics of the above descriptions. It should be understood that the disclosed methods should be considered in a descriptive sense only and not for purposes of limitation. Therefore, the scope of the present disclosure is defined not by the detailed description of the present disclosure but by the appended claims, and all differences within the scope will be construed as being included in the present disclosure.

What is claimed is:

1. An aerosol generating apparatus comprising:

a cavity formed on one end of the aerosol generating apparatus and configured to accommodate a cigarette inserted into the cavity;

a controller configured to:

count a number of times of smoking, with consumption of one cigarette being considered one time of smoking, when a cigarette is inserted into the cavity, determine whether a smoking restriction condition is satisfied based on an accumulated number of times of smoking, and execute a smoking restriction mode if the smoking restriction condition is satisfied; and a heater configured to heat the cigarette inserted into the cavity under control of the controller to generate an aerosol, wherein the controller is further configured to, when the smoking restriction mode is executed, control the heater to heat the inserted cigarette at a low temperature range to generate a smaller amount of aerosol than in a smoking mode where the smoking restriction condition is not satisfied, and wherein the low temperature range is a temperature range lower than a temperature range of the heater in the smoking mode.

2. The aerosol generating apparatus of claim 1, wherein the controller controls the heater to operate in the smoking restriction mode or in the smoking mode after preheating of the heater.

3. The aerosol generating apparatus of claim 1, wherein the controller is configured to determine a start and an end of smoking, based on at least one of a button input via an interface, sensing of insertion and extraction of a cigarette, sensing of a puff due to change in a heater temperature, and sensing of a puff due to change in a flow rate.

4. The aerosol generating apparatus of claim 1, wherein the controller is configured to, in the smoking restriction mode, provide a notification indicating that the smoking restriction mode has been activated using at least one of a display, a lamp, a speaker, and a motor vibration.

5. The aerosol generating apparatus of claim 1, wherein the smoking restriction condition is set based on at least one of setup information inputted via an interface, setup information received from an external device via wireless communication, and setup information received from an external device via wired communication when the aerosol generating apparatus is coupled with a cradle device.

* * * * *